US009394660B2

(12) United States Patent
Bishop et al.

(10) Patent No.: US 9,394,660 B2
(45) Date of Patent: Jul. 19, 2016

(54) ENERGY ABSORPTION MANAGEMENT FOR MARINE BARRIER AND GATE SYSTEMS

(71) Applicant: HALO Maritime Defense Systems, Inc., Newton, NH (US)

(72) Inventors: Justin Bishop, West Caldwell, NJ (US); Judson DeCew, Rochester, NH (US); Eric G. Johnson, Danvers, MA (US)

(73) Assignee: HALO MARITIME DEFENSE SYSTEMS, INC., Newton, NH (US)

( * ) Notice: Subject to any disclaimer, the term of this patent is extended or adjusted under 35 U.S.C. 154(b) by 0 days.

(21) Appl. No.: 14/554,233

(22) Filed: Nov. 26, 2014

(65) Prior Publication Data

US 2015/0152615 A1 Jun. 4, 2015

Related U.S. Application Data

(60) Provisional application No. 61/908,936, filed on Nov. 26, 2013.

(51) Int. Cl.

| | |
|---|---|
| ***E02B 3/04*** | (2006.01) |
| ***E02B 3/06*** | (2006.01) |
| ***B63G 9/04*** | (2006.01) |
| ***E02B 7/20*** | (2006.01) |
| ***E02B 15/08*** | (2006.01) |
| ***E02B 3/20*** | (2006.01) |
| ***F41H 11/05*** | (2006.01) |

(52) U.S. Cl.

CPC ... *E02B 3/06* (2013.01); *B63G 9/04* (2013.01); *E02B 3/20* (2013.01); *E02B 7/20* (2013.01); *E02B 15/08* (2013.01); *F41H 11/05* (2013.01); *E02B 3/062* (2013.01)

(58) Field of Classification Search

CPC ..... F41H 11/05; B23G 9/04; E02B 3/04; E02B 3/062; E02B 7/30

See application file for complete search history.

(56) References Cited

U.S. PATENT DOCUMENTS

| | | | |
|---|---|---|---|
| 1,158,555 | A | 11/1915 | Prescott |
| 1,278,970 | A | 9/1918 | Maxwell |
| 1,299,243 | A | 4/1919 | Sheransky |
| 2,041,662 | A | 5/1936 | Mapes |
| 2,716,959 | A | 9/1955 | Betts |

(Continued)

OTHER PUBLICATIONS

International Search Report and Written Opinion of the International Searching Authority mailing date Feb. 25, 2015 in PCT/US2014/067524.

(Continued)

*Primary Examiner* — Benjamin Fiorello

(74) *Attorney, Agent, or Firm* — Miles & Stockbridge P.C.; Michael A. Messina

(57) ABSTRACT

A marine barrier has buoyant panels elastically connected with an included angle therebetween, to form a pleated row of panels with hinges arranged in first and second rows. An impact net having cables is attached to a net connection portion of each hinge in the first row. The net connection portions are attachable to the cables with a tension such that, when the barrier is floating and a moving vessel impacts the net, an impact force causes the cables to move relative to the net connection portions, transferring a portion of the force of the impact to the net connection portions, until cable stops on the cable ends engage net connection portions adjacent the cable stops. The force of the impact is then transferred to the panels, which engage the water to transfer the force of the impact to the water, to arrest the motion of the vessel.

22 Claims, 22 Drawing Sheets

(56) References Cited

U.S. PATENT DOCUMENTS

| | | | | |
|---|---|---|---|---|
| 3,020,567 | A | 2/1962 | Colt | |
| 3,185,445 | A | 5/1965 | Broadway | |
| 3,499,291 | A * | 3/1970 | Trygve | E02B 15/08 210/924 |
| 6,591,774 | B2 | 7/2003 | Metherell | |
| RE40,616 | E | 1/2009 | Nixon | |
| 2004/0018060 | A1 | 1/2004 | Knezek | |
| 2004/0115002 | A1 | 6/2004 | Meeks | |
| 2006/0037526 | A1 * | 2/2006 | Knezek | B63B 5/24 114/267 |
| 2007/0102689 | A1 | 5/2007 | Alberson | |
| 2008/0105184 | A1 * | 5/2008 | Nixon | F41H 11/05 114/241 |
| 2009/0035068 | A1 * | 2/2009 | Terai | B63G 9/04 405/211 |
| 2013/0108368 | A1 | 5/2013 | Bishop | |

OTHER PUBLICATIONS

International Search Report and Written Opinion of the International Searching Authority mailing date Feb. 24, 2015 in PCT/US2014/067558.

* cited by examiner

ENERGY ABSORPTION MANAGEMENT FOR MARINE BARRIER AND GATE SYSTEMS

RELATED APPLICATIONS

The present application claims priority to U.S. Provisional Application No. 61/908,936, entitled "Improvements to Marine Barrier and Gate Systems," filed Nov. 26, 2013, which is incorporated herein by reference in its entirety.

TECHNICAL FIELD

The present subject matter relates to marine barriers and movable gates. The present disclosure has particular applicability to marine barriers for arresting the motion of a vessel impacting the barrier.

BACKGROUND

Structures for use on both land and/or water as security barrier systems have been previously developed. Such structures generally intend to stop intruding objects, and range from thick, solid walls blocking the object's progress to secured areas for disabling the propelling mechanism of the object. These structures commonly exhibit noticeable shortcomings. First, these structures are often cumbersome and time-consuming to install and erect as and where desired. Second, they are difficult, or even impossible, to maintain and/or repair after they have sustained the impact of an intruding object. Third, they are often not adaptable to different needs and conditions.

One solution providing an improved marine barrier is shown in FIG. 1 and disclosed in U.S. patent application Ser. No. 13/586,270, filed Aug. 15, 2012, and published as US 2013/0119334, which is hereby incorporated by reference in its entirety. The marine barrier 1400 of FIG. 1 includes two continuous pleated rows 1401, 1402 of first and second respective pluralities of buoyant panels 1110, to form a diamond-shaped barrier. A plurality of outboard hinges 1120 and a plurality of inboard hinges 1420 elastically connect opposing sides of adjacent panels 1110 with the included angle A therebetween to form two continuous pleated rows 1401, 1402, such that the hinges 1120, 1420 are arranged in first, second, and third substantially parallel rows 1410*a-c*.

A first plurality of impact cables 1430 are attached to opposing ends of the first pleated row of panels 1401 and pass through each of the hinges 1120 in the first row of hinges 1410*a*. A second plurality of impact cables 1430 are attached to opposing ends of the second pleated row of panels 1402 and pass through each of the hinges 1120 in the third row of hinges 1410*c*. In this example, there are five impact cables 1430 associated with each of the pleated rows 1401, 1402, and they are substantially parallel to each other. Impact cables 1430 comprise, for example, steel wire rope.

When the barrier 1400 is floating in a body of water 1440 and a moving vessel (represented by arrow 1450) impacts one or more of the first plurality of impact cables 1430 attached to the first pleated row 1401 of panels 1110, the impact cables 1430 deflect to transfer a force of the impact to one or more of the first plurality of panels 1110 of the first pleated row 1401, which in turn engage the water 1440, and to one or more of the second plurality of panels of the second pleated row 1402, which in turn engage the water 1440, to transfer the force of the impact to the water 1440 and arrest the motion of the vessel 1450.

Likewise, if a vessel impacts one or more of the second plurality of impact cables 1430 attached to the second pleated row 1402, the load path of the impact force will be similar, but in an opposite direction. Thus, during an impact the panels 1110 are drawn in around the point of impact and engage the water 1440 to dissipate the impact force.

The marine barrier of FIG. 1 is a vast improvement over previous barriers, but is not optimized for maximum effectiveness. For example, since the impact cables 1430 are rigidly attached at opposing ends of the barrier and simply pass through the hinges 1120, the impact cables 1430 cannot be advantageously used to control the transfer of impact forces to the barrier at the initial time of impact of a vessel, to arrest the motion of the vehicle more effectively and reliably. They do not control transfer of the impact force to the barrier until they have deflected towards the central row of hinges 1420 and have stretched a significant amount (typically several feet) so that the force is transferred to the ends of the barrier 1400.

Further, the barrier 1400 of FIG. 1 is primarily intended to deter a small vessel attack. A larger vessel will most likely run over barrier 1400 and potentially get delayed and become ensnared in barrier 1400, but may not be captured by barrier 1400.

There exists a need for a marine barrier with improved energy absorption management to increase its effectiveness and reliability. There is also a need for a marine barrier capable of capturing relatively large vessels.

SUMMARY

The present disclosure provides a marine security barrier system that addresses the aforementioned needs.

Embodiments include a marine barrier comprising a first plurality of substantially vertical panels, each of the panels having a buoyant bottom portion, and a pair of opposing sides. A plurality of hinges elastically connects a side of a first one of the panels to a side of an adjacent second one of the panels with an included angle therebetween, to form a buoyant continuous first pleated row of panels, such that the hinges are arranged in first and second substantially parallel rows. Each hinge of the first row of hinges comprises a plurality of elastic portions and a substantially rigid net connection portion. An impact net comprising a plurality of substantially parallel, substantially horizontal impact cables is attached to the net connection portion of each of the hinges in the first row of hinges, and opposite ends of the impact cables each have a cable stop rigidly attached thereto. The net connection portions of the first row of hinges are attachable to the impact cables with a predetermined tension such that, when the barrier is floating in a body of water and a moving vessel impacts the impact net, a force of the impact causes the impact cables to move relative to the net connection portions, transferring a portion of the force of the impact to the net connection portions, until the cable stops engage corresponding ones of the net connection portions adjacent the cable stops, and after the cable stops engage the corresponding ones of the net connection portions, the force of the impact is transferred to one or more of the first plurality of panels, which in turn engage the water to transfer the force of the impact to the water, to arrest the motion of the vessel.

Embodiments can also include the barrier wherein the elastic portions of the hinges each comprise a flexible central portion and a pair of opposed outer faceted portions, wherein one of the faceted portions is for engaging a faceted track in one of the panels to attach the elastic portion to the one of the panels, and the other faceted portion is for engaging a faceted track of one of the net connection portions of one of the first row of hinges to attach the elastic portion to the one of the net connection portions.

Embodiments can further comprise the barrier wherein each of the inboard hinges comprises a substantially vertical central column, and the barrier further comprises a cable support pole extending upward from a top surface of the central column of each of the inboard hinges; and an upper impact cable extending substantially horizontally between the cable support poles. The upper impact cable is for impacting a superstructure or deck gear of the moving vessel when the vessel impacts the first or second impact net, to arrest the motion of the vessel.

Objects and advantages of embodiments of the disclosed subject matter will become apparent from the following description when considered in conjunction with the accompanying drawings.

BRIEF DESCRIPTION OF THE DRAWINGS

Embodiments will hereinafter be described in detail below with reference to the accompanying drawings, wherein like reference numerals represent like elements. The accompanying drawings have not necessarily been drawn to scale. Where applicable, some features may not be illustrated to assist in the description of underlying features.

DETAILED DESCRIPTION

It should be understood that the principles described herein are not limited in application to the details of construction or the arrangement of components set forth in the following description or illustrated in the following drawings. The principles can be embodied in other embodiments and can be practiced or carried out in various ways. Also, it is to be understood that the phraseology and terminology used herein is for the purpose of description and should not be regarded as limiting.

Disclosed herein are marine barrier and gate systems incorporating advanced energy absorption management techniques for improved effectiveness and reliability, and the ability to capture relatively large vessels such as fishing boats.

Impact Net Payout

Figure 2A:
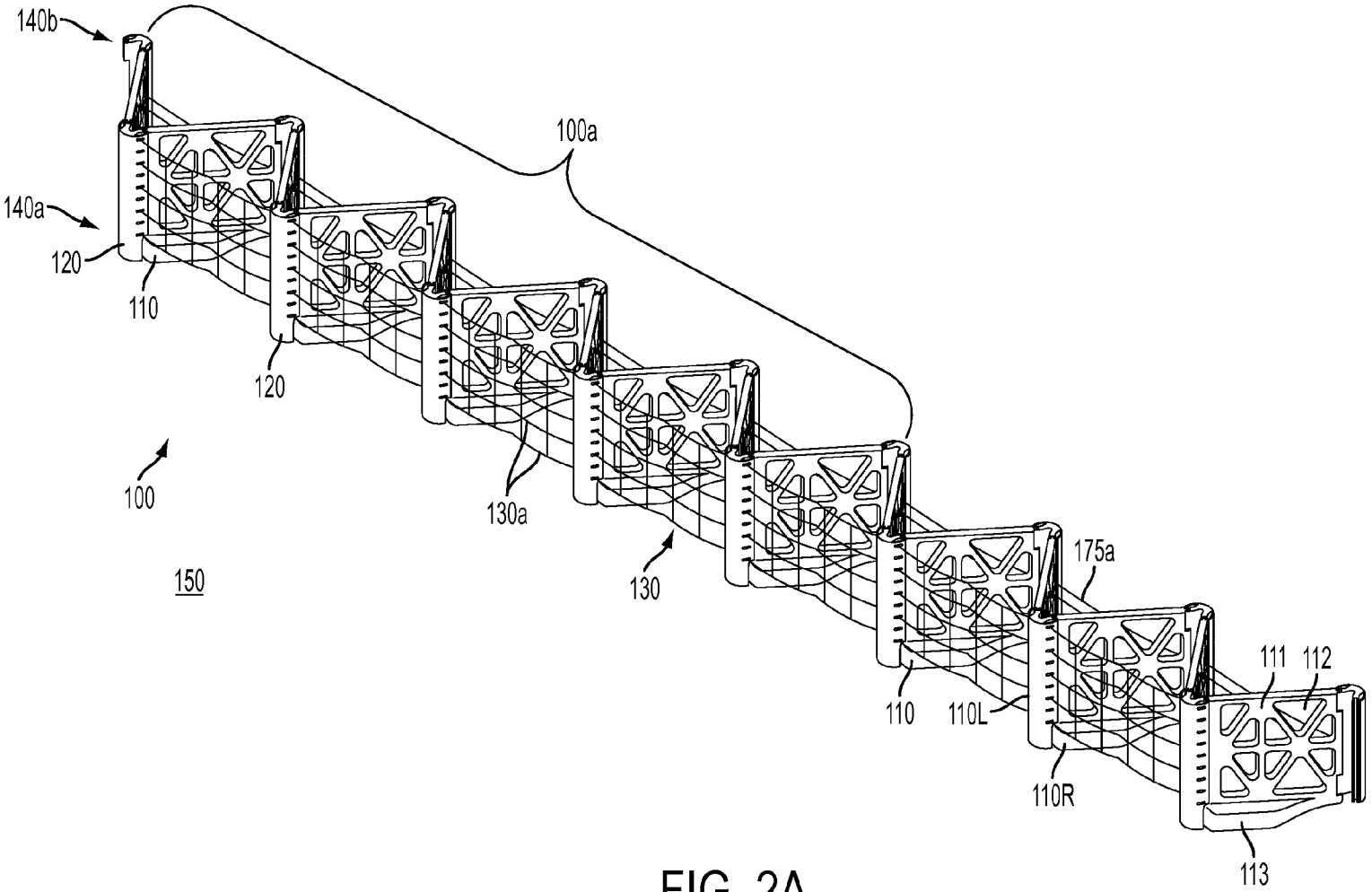
FIG. 2*a* is a perspective view diagrammatically illustrating an exemplary marine barrier according to various embodiments.

An embodiment of the disclosure will now be described in detail with reference to FIGS. 2*a-b*. A marine barrier 100 comprises a first plurality of substantially vertical panels 110 assembled to form a zig-zag shaped (i.e., pleated) barrier, each of the panels 110 having a pair of opposing sides 110R and 110L. Each of the panels 110 includes a frame 111 comprising metal and having a plurality of through holes 112 extending from one major surface to another major surface for allowing passage of water and wind through the panel, a plastic coating encapsulating the frame 111, and a buoyancy portion 113 at the bottom of the frame 111. Buoyancy portion 113 can be integral with frame 111, or a separate structure attached to frame 111.

Figure 3A:
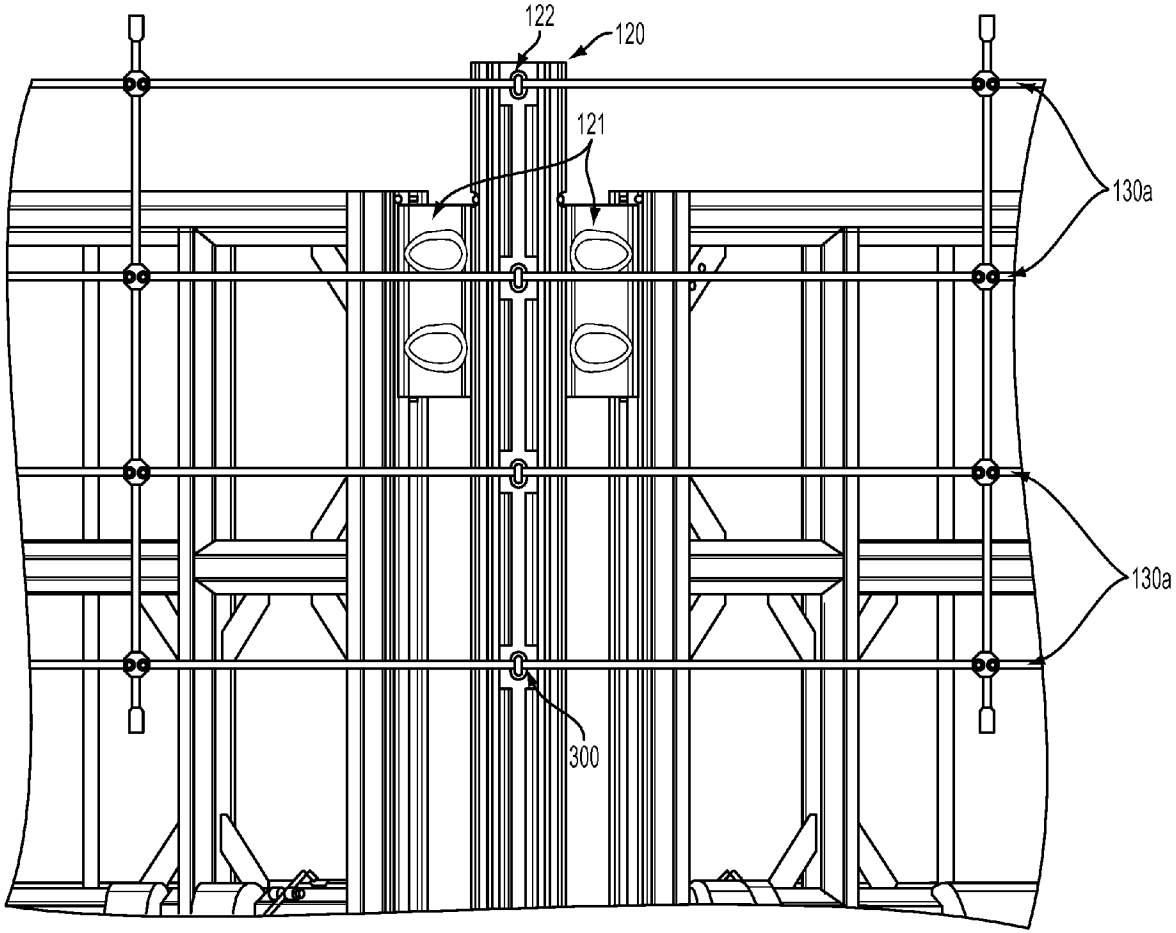
FIGS. 3*a-e* diagrammatically illustrate exemplary impact net attachment embodiments in accordance with the disclosure.

A plurality of hinges 120 each elastically connect an outboard side of a first one of the panels 110 to a side of an adjacent second one of the panels 110 with an included angle A therebetween, to form a buoyant continuous first pleated row of panels 101, such that the outboard hinges 120 are arranged in first and second substantially parallel rows 140*a*, 140*b*. As best seen in FIG. 3*a*, which is a close-up view of an outboard hinge 120, each outboard hinge 120 comprises a plurality of elastic portions 121, such as comprising rubber, and a substantially rigid net connection portion 122, such as an extruded aluminum column.

An impact net 130 comprising a plurality of substantially parallel, substantially horizontal impact cables 130*a* are attached to the net connection portion of each of the hinges 120 in the first row of hinges. In the embodiment shown in FIGS. 2*a-b*, there are four horizontal impact cables 130*a* in impact net 130, and they are substantially parallel to each other. Impact net 130 comprises, for example, steel wire rope. For ease of assembly and replacement, the net 130 is segmented; e.g., every five "pleats" of the barrier 100, upon the net connection portion 122*a* referred to herein as a "split column," as shown in FIG. 3*c* and discussed in detail herein below. The ends of each horizontal impact cable 130*a* of a five-pleat-long net segment 100*a* have a swaged steel stop 130*b* (see FIG. 3*c*).

Referring now to FIGS. 3*a-e*, the substantially horizontal wire impact cables 130*a* of the net 130 are attached to the net connection portions 122 of the outboard hinges 120 of the barrier by U-bolts 300. Each of the U-bolts 300 presses down on a wire cable 130*a*, holding it against a net connection portion 122. FIG. 3*a* shows an impact net 130 in the middle of a five-pleat net segment 100*a* mounted on the net connection portion 122 of an outboard hinge 120 via U-bolts 300.

Figure 3B:
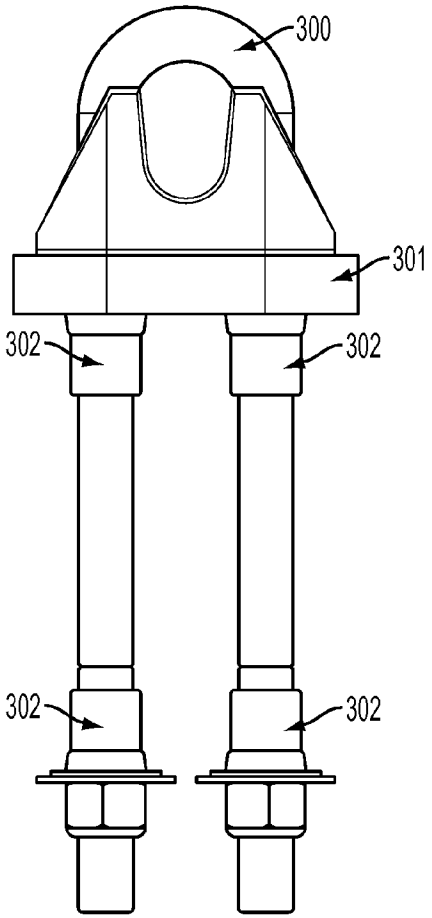

The U-bolts 300, an example of which is shown in FIG. 3*b*, are used to maintain the tension of the net 130 locally, thereby preventing sag in the net between net connection portions 122 (each of the net connection portions 122 has a set of U-bolts 300 for holding the cables 130*a*). By maintaining a nominal tension on the net/U-bolt interface, the net 130 can be in position to receive the impact of a high speed boat at a point advantageous to affect a capture of the vessel's nose. The U-bolts 300 each have a polymer plate 301 and inserts 302 as insulators to isolate the net 130 and the U-bolts 300 from the column 122. Each horizontal impact cable's swaged end 130*b* and several inches of extra cable are spaced apart from the U-bolt/net interface area, as shown in FIGS. 3*c* and 3*d*, which depict a joint between five-pleat segments 100*a*, which features a "split" net attachment portion 122*a* comprising two columns 122*b* attached to each other.

Figure 3C:
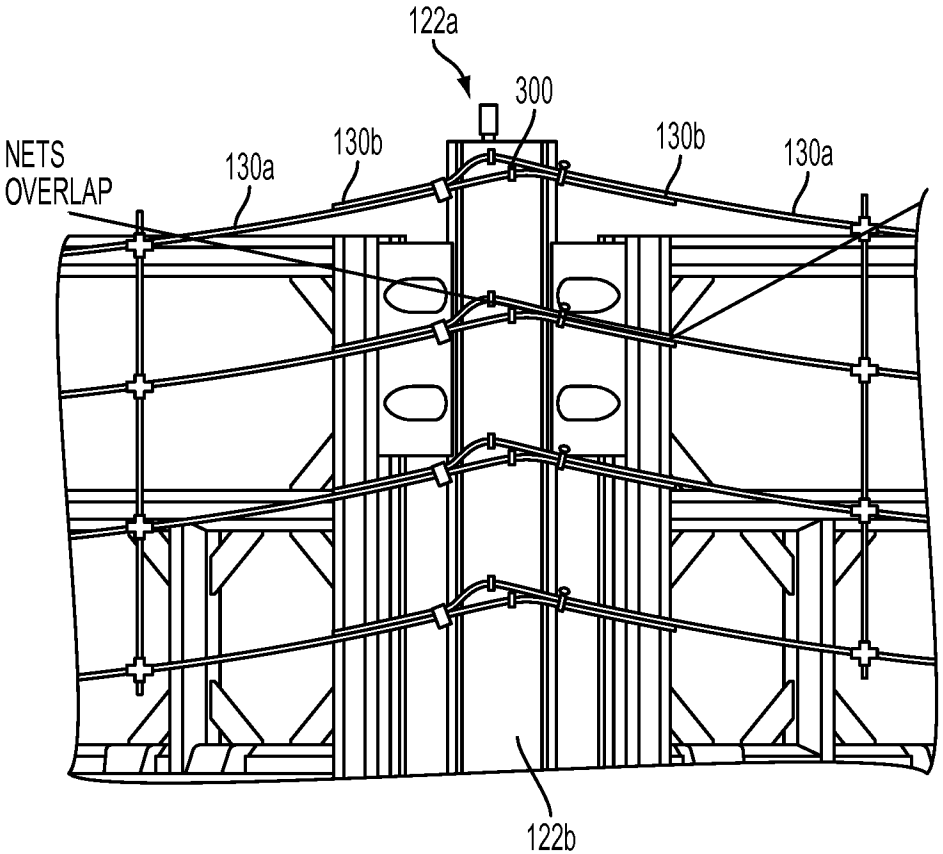
Figure 3D:
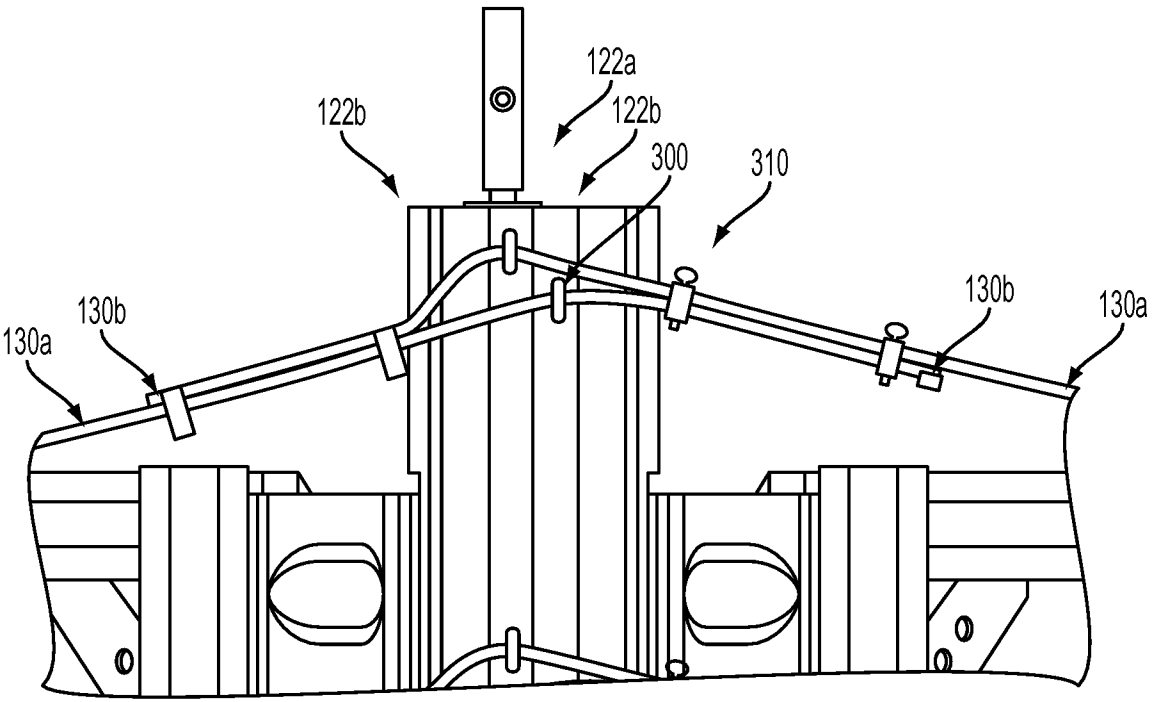
Figure 3E:
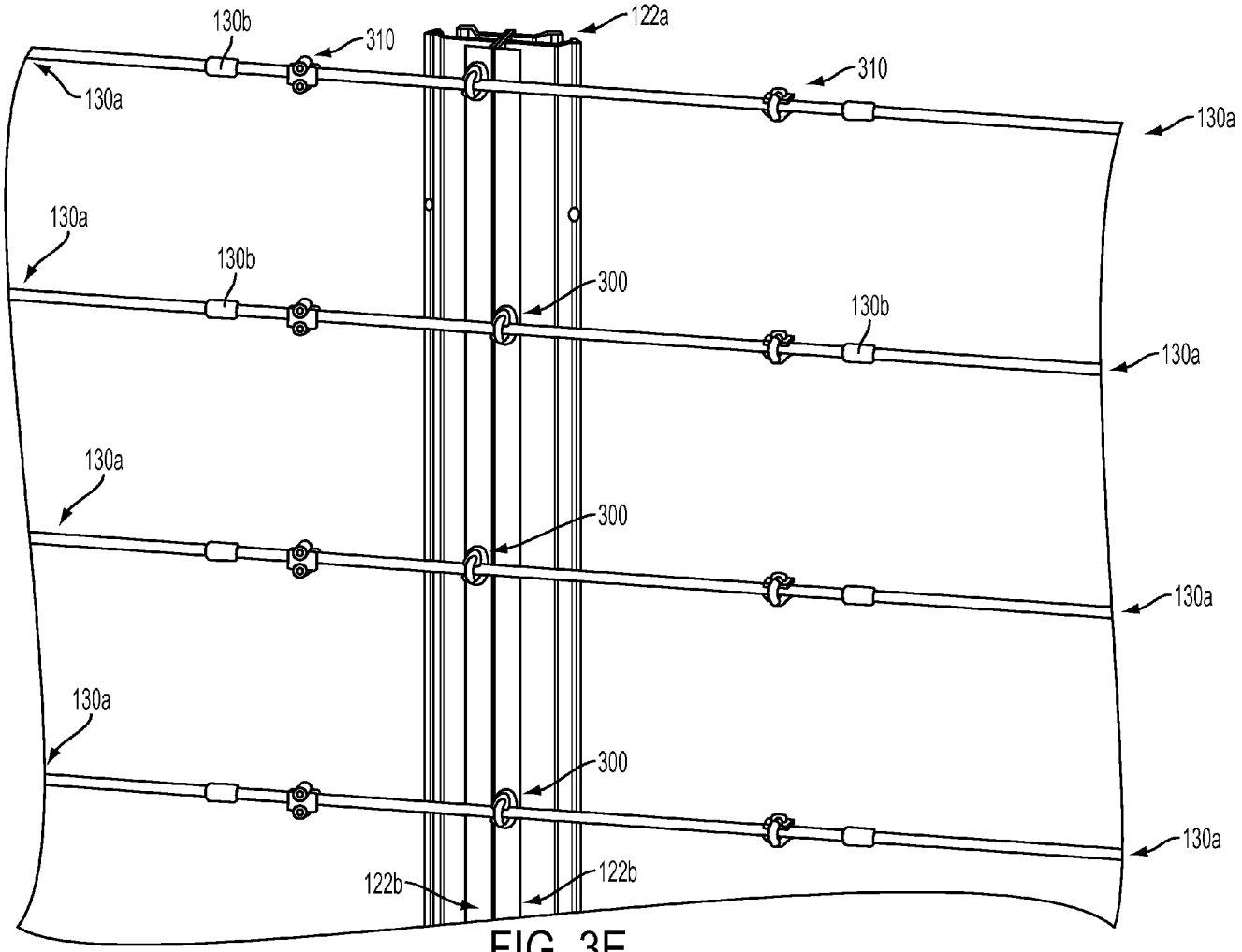

An alternative embodiment of a joint between five-diamond segments 100*a* is shown in FIG. 3*e*, which features offset U-joints 300 on the split column 122*a* as in the embodiment of FIGS. 3*c* and 3*d* to minimize hardware, and also includes redundant clips 310 to secure the wire 130*a*. Note also that the net 130 and the attachment clips 310 are isolated from the columns 122*b*, 122*b* via the polymer plates 301 and inserts 302 of the U-bolts 300.

Referring again to FIGS. 2*a-b*, the net connection portions 122, 122*a* of the first row of hinges 140*a* are attached to the impact cables 130*a* with a predetermined tension (e.g., via U-bolts 300 pressing the impact cables 130*a* against the net connection portions 122, 122*a* (i.e., the columns of the net connection portions) such that, when the barrier 100 is floating in a body of water 150 and a moving vessel, represented by arrow 160, impacts the impact net 130, a force of the impact causes the impact cables 130*a* to move relative to the net connection points (i.e., the net/U-bolt interfaces), transferring a portion of the force of the impact to the net connection portions 122,122*a* until the cable stops 130*b* engage corresponding ones of the U-bolts 300 of the net connection portions 122, 122*a*. After the cable stops 130*b* engage the U-bolts 300, the force of the impact is transferred to one or more of the first plurality of panels 110, which in turn engage the water 150 to transfer the force of the impact to the water 150, to arrest the motion of the vessel 160. The load path of the impact force of the moving vessel is shown in FIG. 2*b* by lines X, Y, and Z, representing the impact force as it moves from the impact cables 130 (line X) to the panels 110 (line Y) and the hinges 120 (lines X and Z). Thus, during an impact the panels 110 are drawn in around the point of impact and engage the water 150 to dissipate the impact force.

Thus, when a high speed vessel impact occurs against the face of net 130 of barrier 100, the prow of a vessel becomes entangled in the net's steel cable construction. The kinetic energy of the vessel's impact is transferred through the net to the entirety of the barrier; the net begins the energy transfer when the net is drawn in around the vessel's prow. Depending on vessel construction, the steel cables of the barrier can tear into the hull of the vessel, arresting the vessel's forward motion and damaging it significantly.

As the net is impacted, each horizontal impact cable 130*a* is drawn towards the point of impact, and the cables 130*a* are pulled through the U-bolts 300, each one acting like a friction brake on the net's horizontal cables 130*a*. The U-bolts 300 allow the cables 130*a* to pay out until they reach the swaged stops 130*b* on the ends of the cables. The initiation of cable payout only occurs in the extreme event of a high-speed vessel impact, and begins the release of kinetic energy through friction. When the horizontal cables 130*a* reach their swaged hard stops 130*b*, the outboard columns 122 and panels 110 in turn are drawn in towards the impacting vessel 160. This enhances the capture of the beam of the vessel 160 and initiates transfer of energy to the rest of the barrier system 100.

Figure 1:
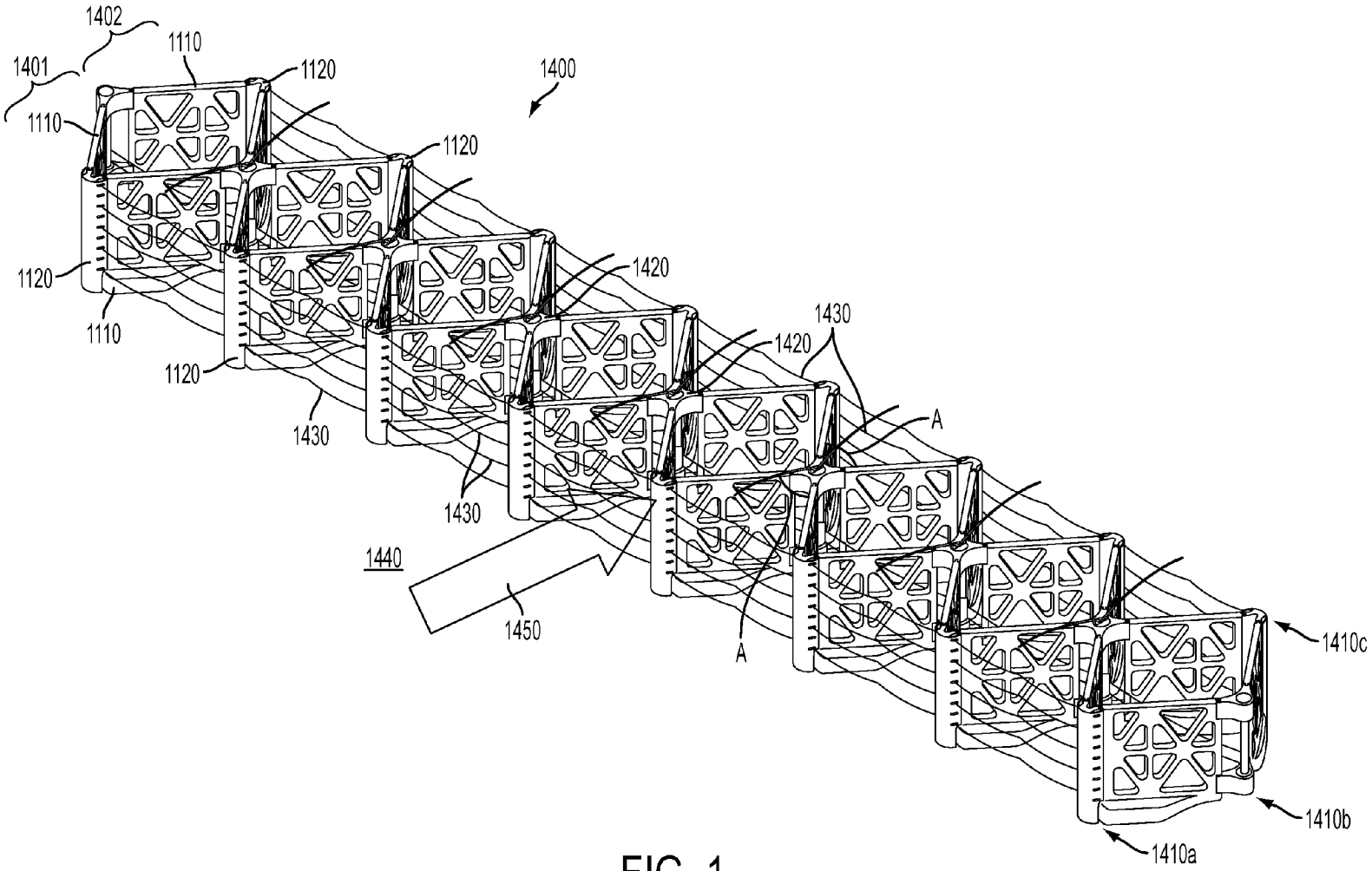
FIG. 1 is a perspective view of a marine barrier.
Figure 4A:
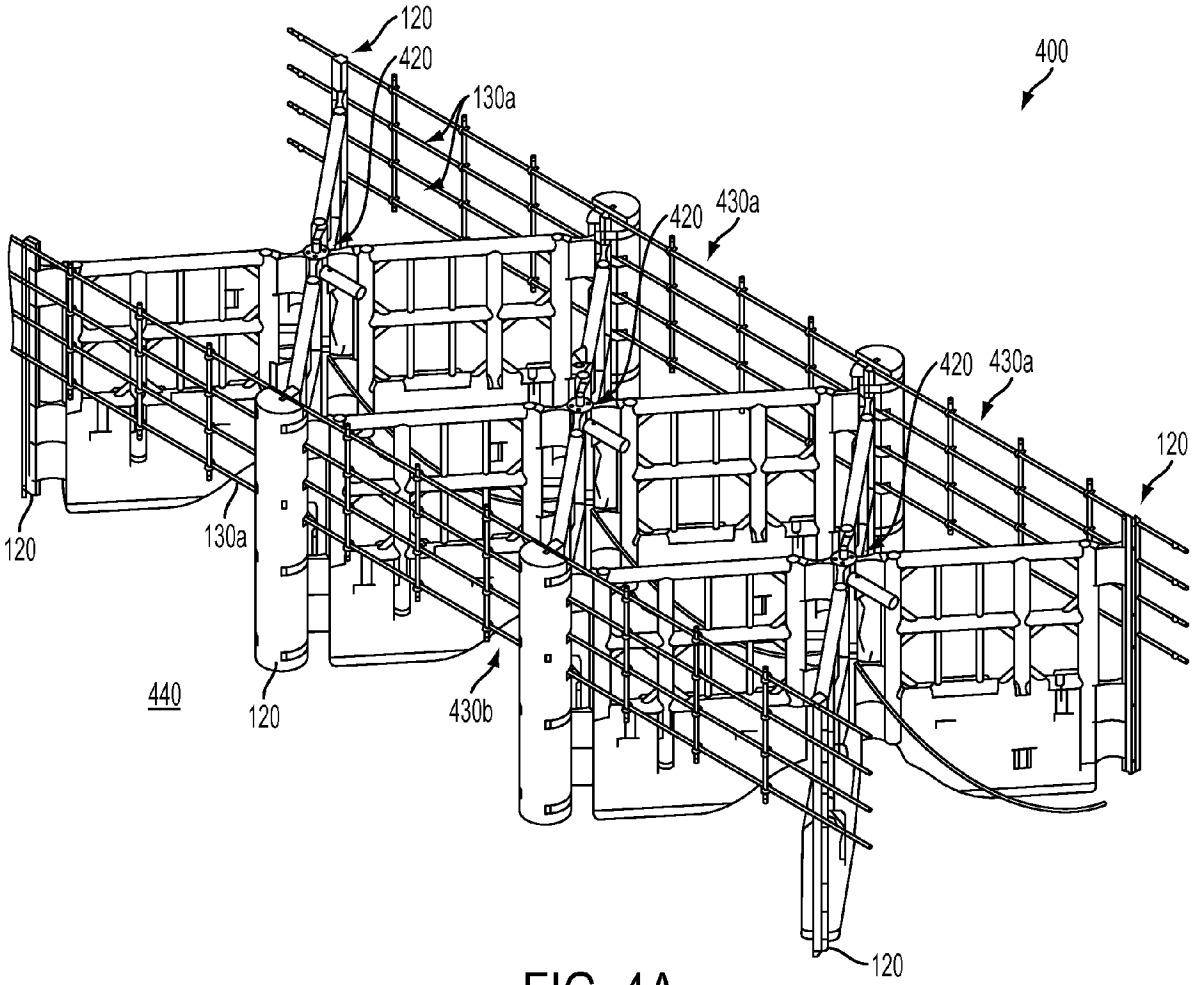
FIG. 4*a* is a perspective view of a marine barrier in accordance with the disclosure.

It should be understood that the disclosed net segmentation and attachment techniques are also usable in embodiments of the disclosed barrier having rows of barrier panels in a diamond configuration, similar to the configuration shown in FIG. 1. These embodiments will now be described with reference to FIGS. 4*a*-5. In this embodiment, a marine barrier 400 includes two continuous pleated rows 401, 402 of first and second respective pluralities of the panels 110, to form a diamond-shaped barrier. A plurality of the outboard hinges 120, and a plurality of inboard hinges 420 (which will be further described herein below) elastically connect opposing sides of adjacent panels 110 with the included angle A therebetween to form the continuous pleated rows 401, 402, such that the hinges 120, 420 are arranged in first, second, and third substantially parallel rows 410*a-c*. As discussed herein above and shown in FIG. 3*a*, each outboard hinge 120 comprises a plurality of elastic portions 121, such as rubber, and a substantially rigid net connection portion 122, such as an extruded aluminum column.

A first impact net 430*a* comprising a plurality of substantially parallel, substantially horizontal first impact cables 130*a* is attached to the net connection portion 122 of each of the hinges 120 in the first row of hinges 410*a*. A second impact net 430*b* comprising a plurality of substantially parallel, substantially horizontal second impact cables 130*a* is attached to each of the net connection portions 122 of each of the hinges 120 in the third row of hinges 410*c*. Impact cables 430*a-b* comprise, for example, steel wire rope. For ease of assembly and replacement, the nets 430*a* and 430*b* are segmented; e.g., every five "diamonds" of the barrier 400, upon a net connection portion 122*a* of an outboard hinge, as shown in FIG. 3*c*. The ends of each impact cable 130*a* of a five-diamond-long net segment 400*a* have a swaged steel stop 130*b*.

The substantially horizontal wire impact cables 130*a* of the first and second impact nets 430*a-b* are attached to the net connection portions 122 of the outboard hinges 120 of the barrier by U-bolts 300 as described herein above with reference to FIGS. 3*a-e*. Each of the U-bolts 300 presses down on a wire cable 130*a*, holding it against a net connection portion 122, 122*a* of an outboard hinge 120. As also discussed above, the U-bolts 300 are used to maintain the tension of the nets 430*a-b* locally, thereby preventing sag in the nets, and placing the nets in position to receive the impact of a high speed vessel at a point advantageous to affect a capture of the vessel's nose.

Figure 4B:
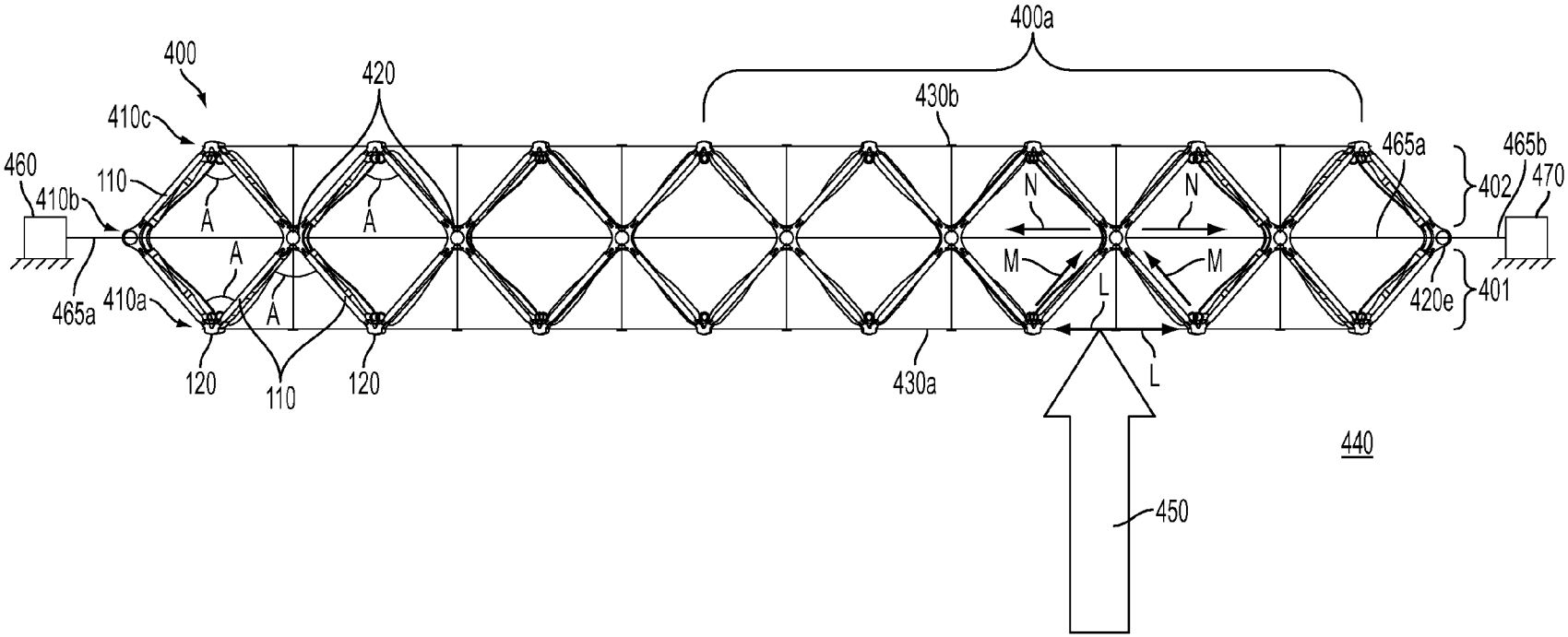
FIG. 4*b* is a top view diagrammatically illustrating the marine barrier of FIG. 4*a*.

The net connection portions 122, 122*a* of the first row of hinges 410*a* are attached to the impact cables 130*a* of the first impact net 430*a* with a predetermined tension (e.g., via U-bolts 300 pressing the impact cables 130*a* against the columns of the net connection portions 122, 122*a*) such that, when the barrier 400 is floating in a body of water 440 and a moving vessel, represented by arrow 450, impacts the first impact net 430*a*, a force of the impact causes its impact cables 130*a* to move relative to the net connection points (i.e., the net/U-bolt interfaces), transferring a portion of the force of the impact to the net connection portions 122, 122*a*, until the cable stops 130*b* engage corresponding ones of the U-bolts 300 of the net connection portions 122, 122*a*. After the cable stops 130*b* engage the U-bolts 300, the force of the impact is transferred to one or more of the first plurality of panels 110 of the first pleated row 401, which in turn engage the water 440, and to one or more of the second plurality of panels 110 of the second pleated row 402, which in turn engage the water 440, to transfer the force of the impact to the water 440 and arrest the motion of the vessel 450. The load path of the impact force of the moving vessel is shown in FIG. 4*b* by lines L, M, and N, representing the impact force as it moves from the impact net 430*a* (lines L) to the panels 110 (lines M) and the hinges 120 and 420 (lines L and N).

Likewise, the net connection portions 122, 122*a* of the third row of hinges 410*c* are attached to the impact cables 130*a* of the second impact net 430*b* with a predetermined tension (e.g., via U-bolts 300 pressing the impact cables 130*a* against the columns of the net connection portions 122, 122*a*) such that, when the barrier 400 is floating in a body of water 440 and a moving vessel, represented by arrow 450, impacts the second impact net 430*b* attached to the second pleated row 402, a force of the impact causes the impact cables 130*a* of the second impact net 430*b* to move relative to the net connection points, transferring a portion of the force of the impact to the net connection portions 122, 122*a*, until the cable stops 130*b* engage corresponding ones of the U-bolts 300 of the net connection portions 122, 122*a*. After the cable stops 130*b* engage the U-bolts 300, the load path of the impact force will be similar, but in an opposite direction to lines L, M, N. shown in FIG. 4*b*. Thus, during an impact the panels 110 are drawn in around the point of impact and engage the water to dissipate the impact force.

Figure 5A:
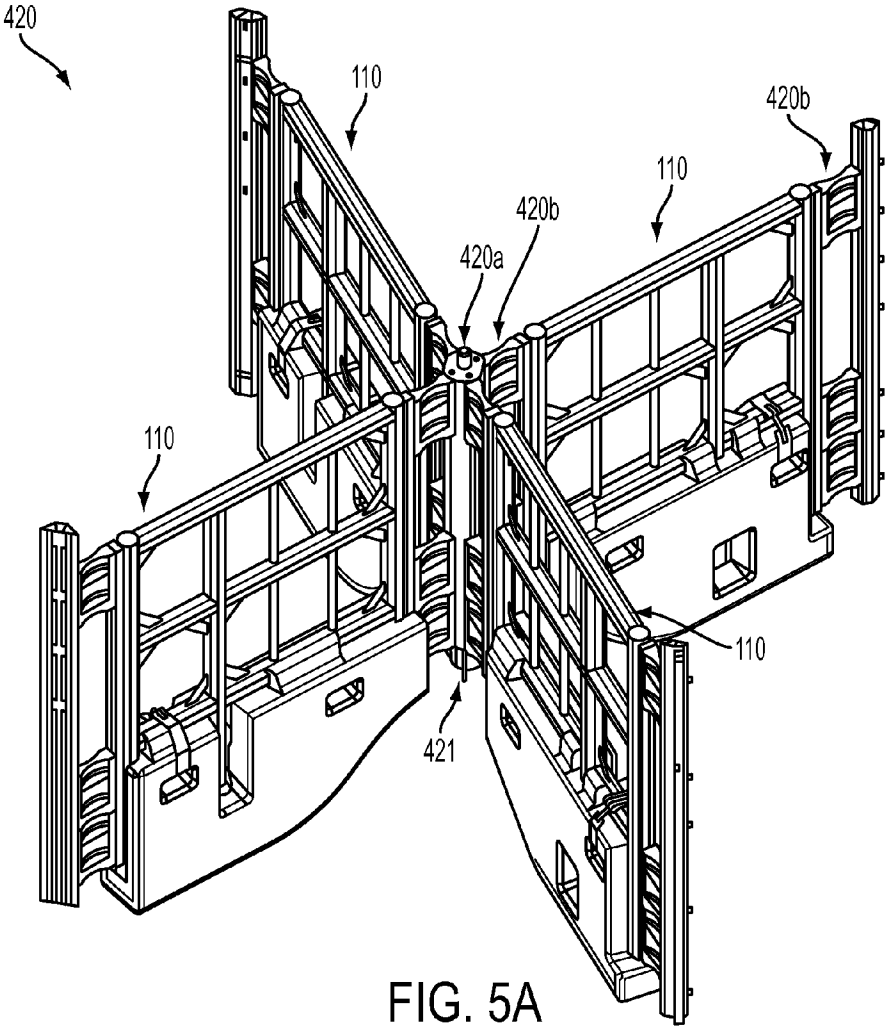
FIGS. 5*a* and *b* are perspective views of barrier hinges according to the present disclosure.

Inboard hinges 420 will now be described with reference to FIG. 5*a*. Each inboard hinge 420 is for joining four panels 110 together, and includes a vertical metal central column 420*a*, such as an extruded aluminum column, and a plurality of elastic portions 420*b*, such rubber, attached to the central column 420*a*. Each elastic portion 420*b* is for attaching to a side of each of four of the panels 110. Elastic portions 420*b* comprise rubber, such as EDPM having a Durometer value ranging from 50-80.

Winch Payout

The outboard hinges 120 and inboard hinges 420 of the disclosed barrier are elastic to enable the panels 110 to move from an expanded position where adjacent ones of the panels 110 are disposed with the included angle A therebetween, to a retracted position where the panels 110 are substantially parallel to each other. Since the disclosed barriers are retractable, they can be used as a gate; for example, to allow vessels to pass into and out of an area protected by the barrier.

Once a vessel impacts a disclosed barrier, kinetic energy is transferred through various mechanisms within the barrier's structure panels, floats, hinges, and columns, into the water surrounding the barrier. When the barrier is used as a gate, a portion of the energy delivered at the point of impact is also transferred, through the central columns of the structure, to a cable or cables, such as haul and catenary cables, used to open and close the gate. The haul and catenary cables are attached to opening and closing winches, which open and close the barrier when it is used as a maritime gate.

The conventional winches used in a gate configuration come with friction brakes. By setting an initial tension on the brakes above the normal operating tension required to open and close the gate and the environmental forces acting upon the structure, but below the high tension experienced in a vessel impact, the winch cables pay out during impact. Winch payout releases the kinetic energy of an impact through friction, and allows the winches to survive forces imparted to the system during impact, keeping it operational after impact.

The amount of cable payout allowed during impact is adjustable by varying the setting of the brake friction on the winches. A user specifies a vessel it considers a threat, and the brake friction is set dependent on the specified vessel's speed and mass, allowing the barrier to be tailored to evolving threats. For example, the brake friction can be set for the highest energy impact expected. In such a case, lower energy impacts are absorbed locally through the net(s) and not the winches, while high energy impacts use both the net(s) locally and the winches. Controlling payout of the winch cables also allows for control of the barrier's excursion distance. Maintaining minimal excursion distance is critical in certain locations where waterway space is limited.

Referring again to FIGS. 2*a-b*, due to their elasticity, hinges 120 enable the panels 110 to move from an expanded position where adjacent ones of the panels 110 are disposed with the included angle A therebetween, to a retracted position where the panels 110 are substantially parallel to each other. A first winch 170 having a conventional friction brake is rigidly mounted, either on land or on a stationary buoy. A first tow cable 175*a* is attached to an end hinge 120*e* of one of the rows of hinges 120 and passes through the other hinges 120 of that row of hinges, for moving the panels 110 from the expanded position to the retracted position by operation of the first winch 170. When the panels are in the expanded position and the moving vessel 160 impacts one of the impact nets, and the barrier transfers the force of the impact to the water, the first tow cable pays out from the first winch by operation of the friction brake of the first winch, to absorb a portion of the kinetic energy of the impact.

Figure 2B:
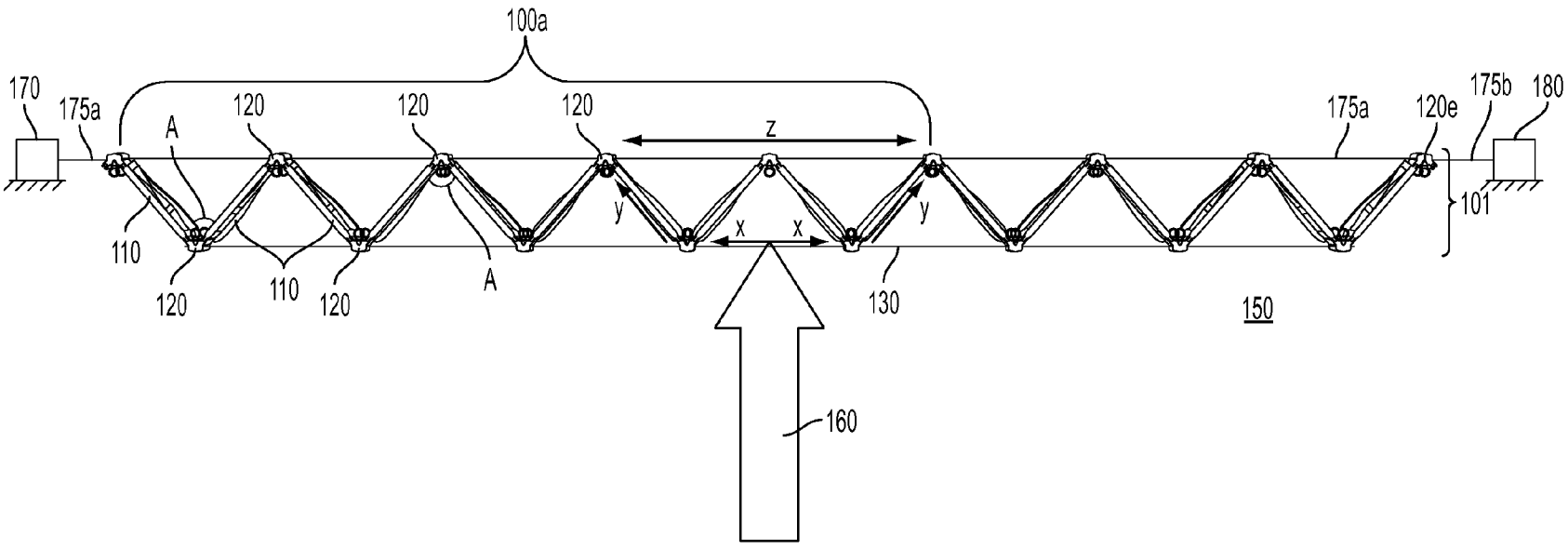
FIG. 2*b* is a top view diagrammatically illustrating the marine barrier of FIG. 2*a*.

As also shown in FIG. 2*b*, a rigidly mounted second winch 180 having a friction brake is also provided. A second tow cable 175*b* is attached to the second winch 180 and attached to the end hinge 120*e* of one of the rows of hinges 120, for moving the panels 110 from the retracted position to the expanded position by operation of the second winch 180. When the panels 110 are in the expanded position and the moving vessel 160 impacts the impact net 130, and the barrier 100 transfers the force of the impact to the water 150, the second tow cable 175*b* pays out from the second winch 180 by operation of the friction brake of the second winch 180, to absorb a portion of the kinetic energy of the impact.

Like the outboard hinges 120, inboard hinges 420 are elastic to enable the panels 110 to move from an expanded position where adjacent ones of the panels 110 are disposed with the included angle A therebetween, to a retracted position where the panels 110 are substantially parallel to each other. Referring again to FIG. 4*b*, a first winch 460 having a conventional friction brake is rigidly mounted, either on land or on a stationary buoy. A first tow cable 465*a* is attached to an end hinge 420*e* of the row of inboard hinges 420 and passes through the other hinges 420 of that row of hinges, for moving the panels 110 from the expanded position to the retracted position. When the panels 110 are in the expanded position and the moving vessel 450 impacts one of the impact net 430*a*, 430*b* and the barrier 400 transfers the force of the impact to the water 440, the first tow cable 165*a* pays out from the first winch 460 by operation of the friction brake of the first winch 460, to absorb a portion of the kinetic energy of the impact.

As also shown in FIG. 4*b*, a rigidly mounted second winch 470 having a friction brake is also provided. A second tow cable 465*b* is attached to the second winch 470 and attached to the end hinge 420*e* of the row of hinges 420, for moving the panels 110 from the retracted position to the expanded position by operation of the second winch 470. When the panels 110 are in the expanded position and the moving vessel 450 impacts one of the impact nets 430*a*, 430*b*, and the barrier 400 transfers the force of the impact to the water 440, the second tow cable 465*b* pays out from the second winch 470 by operation of the friction brake of the second winch 470, to absorb a portion of the kinetic energy of the impact.

Barrier Hinges

Figure 5B:
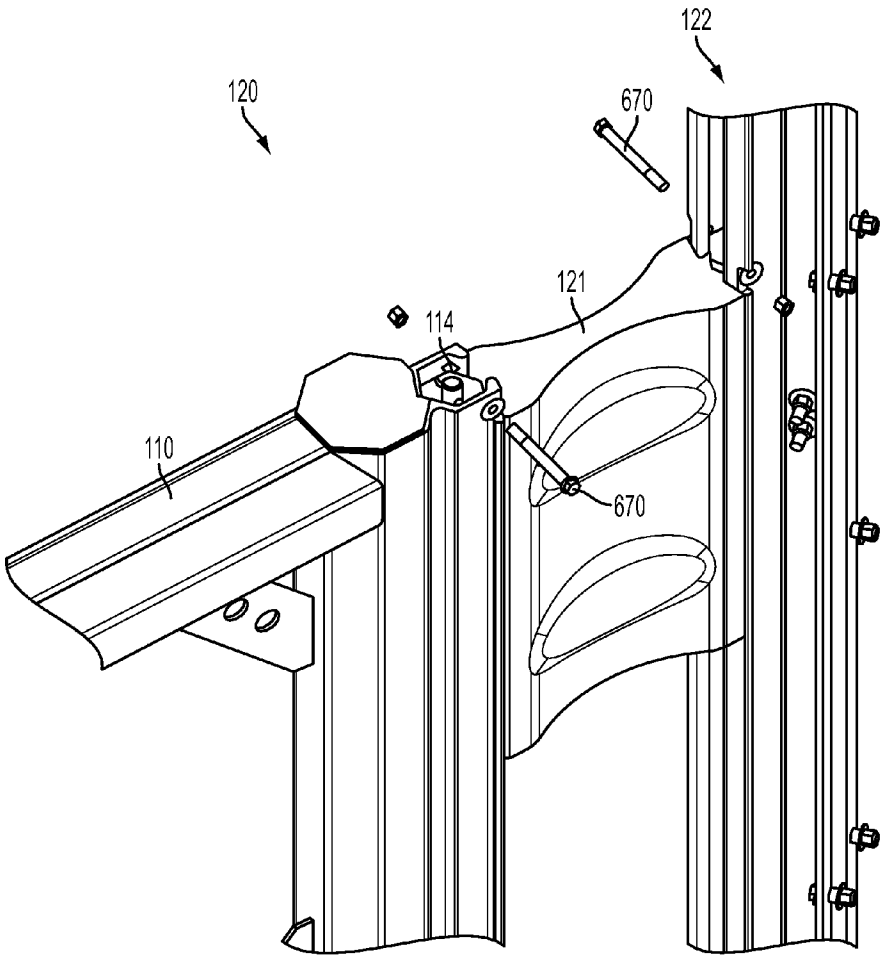

Outboard hinges 120 and inboard hinges 420 are critical to the functionality of the barrier and gate systems described herein to join barrier panels to each other, and provide the flexibility to allow the barriers to absorb impacts and to open and close when used as a gate. FIGS. 5*a* and 5*b* show locations of hinges in a typical barrier assembly. In certain embodiments, the hinges 120, 420 comprise an elastic portion of rubber, such as a 60 Durometer EPDM material. An exemplary rubber elastic portion of a hinge has dimensions of approximately 40 cm wide, 45 cm high, and 10 cm thick, and has a mass of approximately 14 kg.

Figure 6:
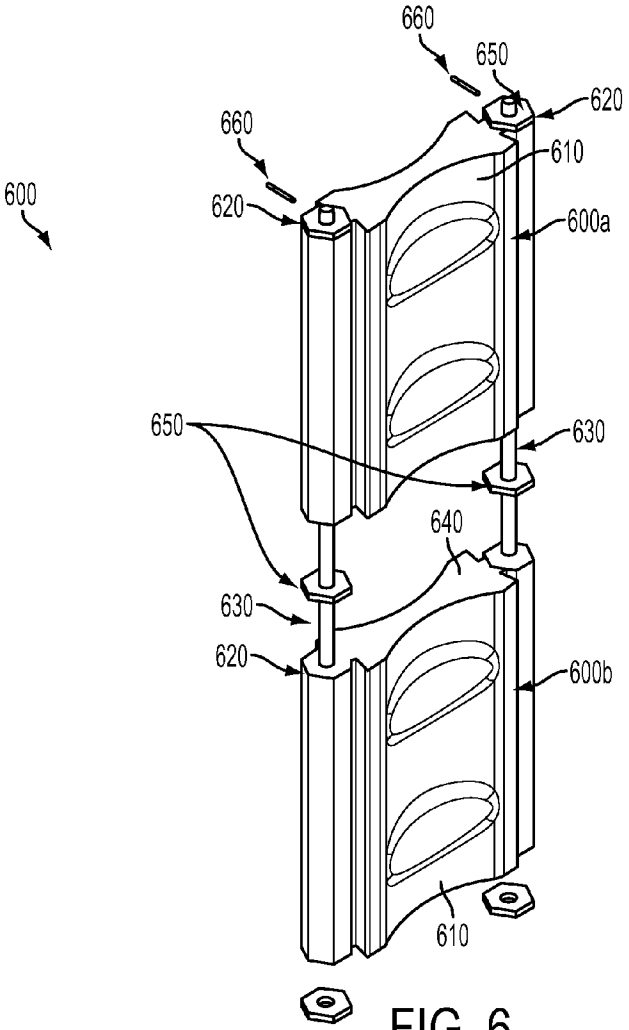
FIG. 6 is an exploded perspective view of an elastic hinge portion for a marine barrier according to various embodiments.
Figure 7:
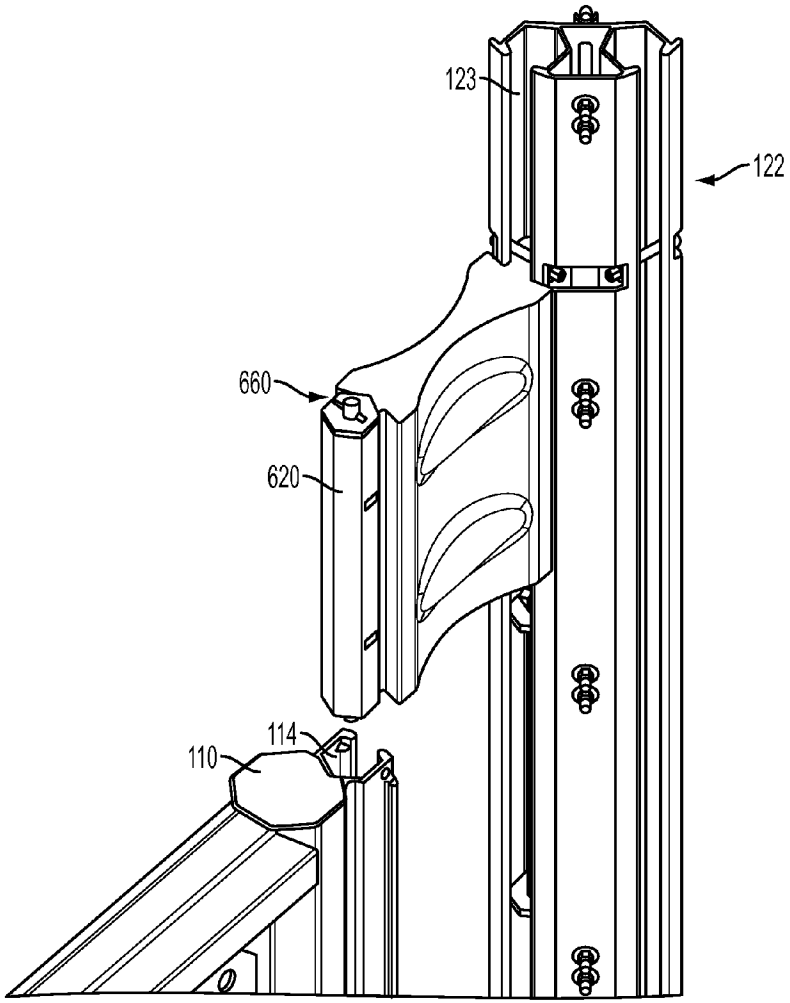
FIG. 7 is a perspective view showing how the elastic hinge portion of FIG. 6 is assembled to a marine barrier according to the present disclosure.
Figure 8:
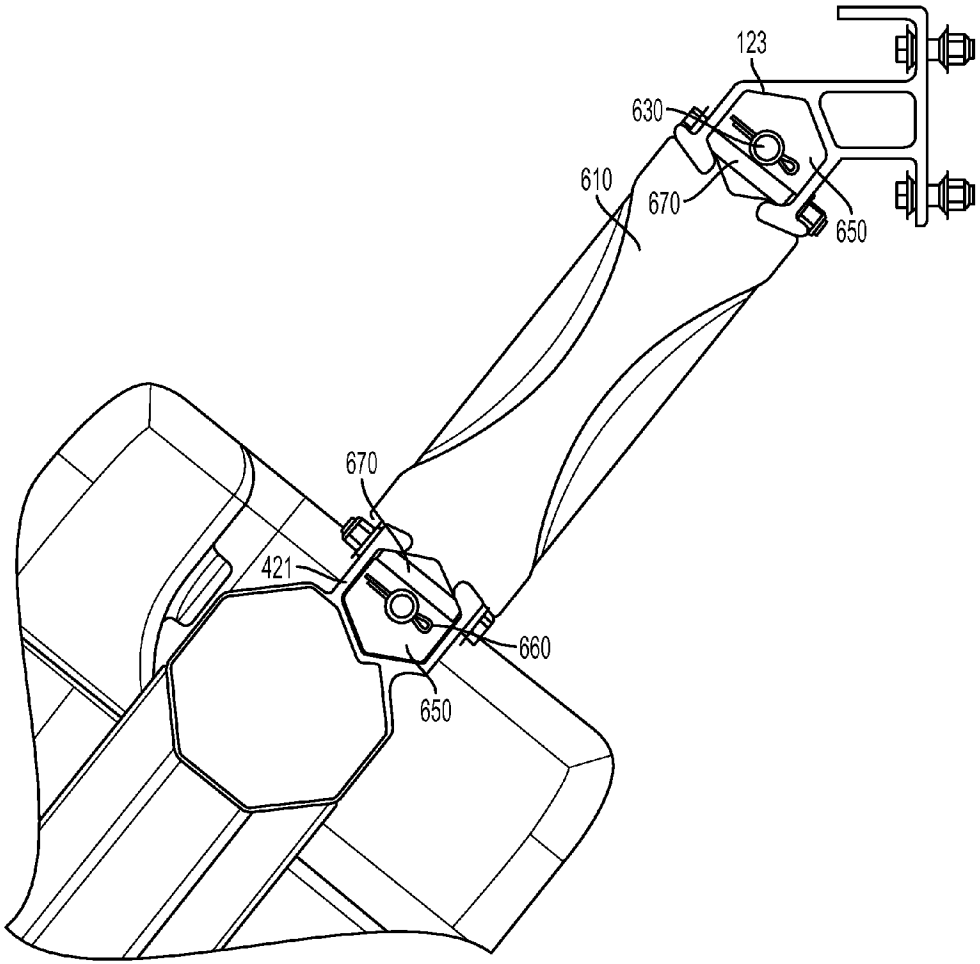
FIGS. 8 and 9 illustrate the hinge of FIG. 6 assembled to a marine barrier according to the present disclosure.
Figure 9:
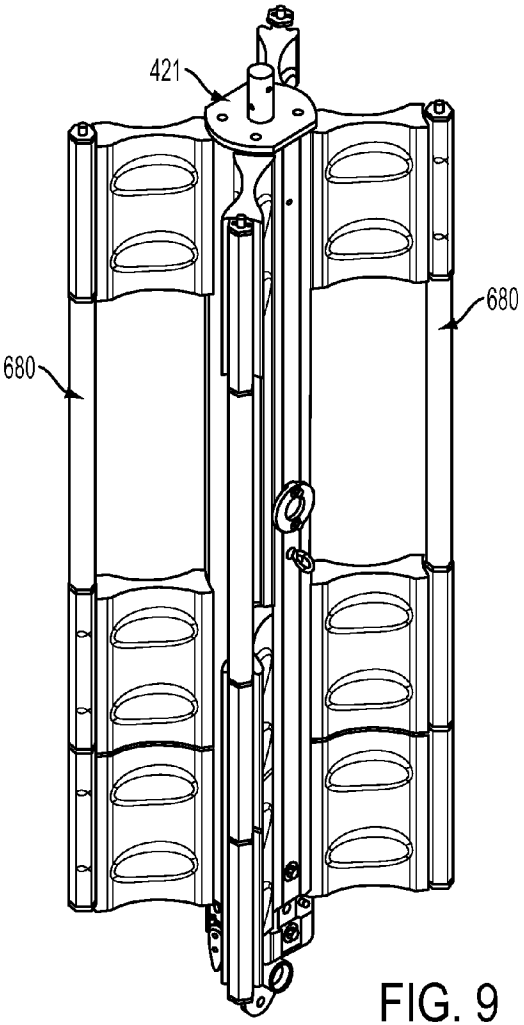

An exploded view of an elastic portion 600 of a hinge assembly according to one embodiment is shown in FIG. 6. Each elastic portion 600 has an upper 600*a* and a lower elastic portion 600*b*, both of which have a central portion 610 that performs most of the flexing, and a pair of opposed outer faceted portions 620. Referring now to FIGS. 7-9, one of the faceted portions 620 is for engaging (e.g., sliding into) a faceted track 114 of an extruded beam attached (e.g. welded) to a barrier panel 110 to attach the elastic portions to the panel 110. The other faceted portion 620 is for sliding into a faceted track 123 in the net connection portion 122 of one of the external hinges 120, or engaging a faceted track 421 in the column 420*a* of one of the inboard hinges 420.

A retaining rod 630, such as a ¾inch aluminum rod, is inserted in a longitudinal through-hole molded into each of the faceted portions 620 of each of the rubber elastic portions 600, for retaining the elastic portion 600 in the faceted tracks 114, 123, 421 of the barrier panels, outboard hinges, or inboard hinges, respectively. Thin metal spacers 640 are placed on the rods 630 between the upper and lower elastic portions 600*a*, 600*b*, and thin metal "fish plates" 650 are placed at the ends of the rods 630 and act as bearing plates for rod retaining pins 660 inserted through a transverse hole in the rods 630 near their ends to retain the rods 630 in place in the faceted portions 620 of the rubber elastic portions 600.

The elastic portions 600 are each installed by sliding them into the faceted track 114 of a beam welded to one of the barrier panels 110, and sliding them into the faceted track 123 of the net connection portion 122 of one of the outboard hinges 120, or the faceted track 421 of the central column 420*a* of one of the inboard hinges 420, and securing them in the tracks via capture bolts 670 and nuts which bear against the fish plates 650. Two elastic portions 600 are spaced from each other and held in place via spacers 680, to provide maximum resistance to bending.

Large Vessel Capture System

Further embodiments of the present disclosure relates to a large vessel capture system usable with the marine barriers and gates described herein with reference to FIGS. 1-9 and in pending U.S. patent application Ser. No. 13/586,270 filed Aug. 15, 2012, which is hereby incorporated by reference in its entirety. Although these barriers are primarily designed to deter a small vessel attack, a version of the barriers designed to incapacitate or delay larger vessels is disclosed herein.

In these embodiments, fiber rope (such as comprising Spectra™ or Dyneema™ rope) is placed above one of the previously disclosed barriers at an angle, orientation and height above the water designed to strike deck gear and the wheel house of an attacking vessel, bringing the vessel to a halt over a defined distance past the barrier. The fiber ropes are large diameter; i.e., no less than 40 mm, and aside from the inherent cut resistance and strength of these synthetic ropes, they also offer a significant time delay as an adversary has to attempt to cut through the ropes for a large vessel to breach the barrier.

Figure 10:
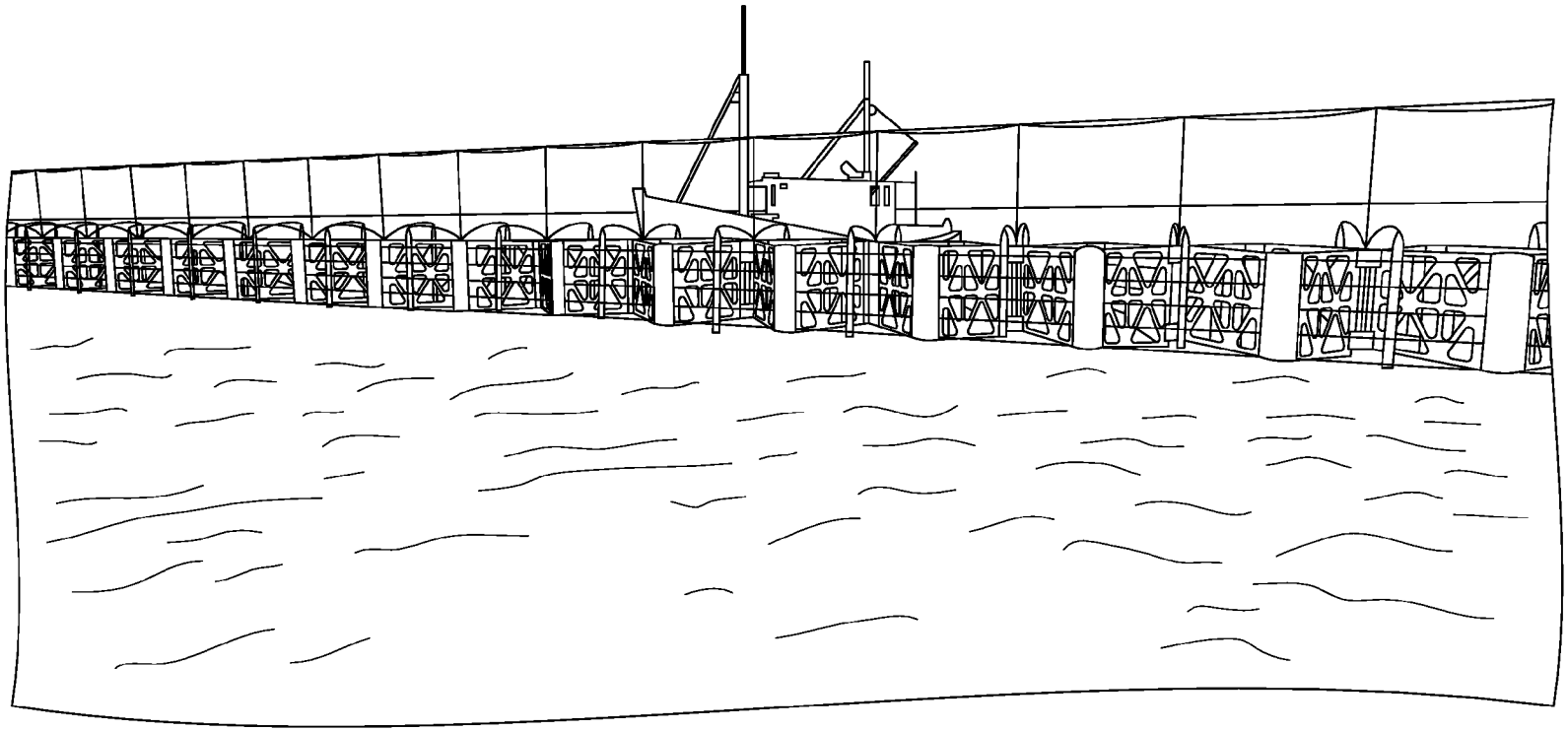
FIGS. 10-11*d* illustrate a large vessel capture system according to the present disclosure.

A large vessel with a steep angled bow will most likely run over any barrier, including the previously disclosed barriers, and potentially get delayed and stuck in the barrier. However, with the addition of stanchions and strong enough ropes, a large vessel could be captured. According to embodiments, the placement of the ropes (see, e.g., FIG. 10) is at a height between 2.5-7 m above the water, to bring the deck gear and wheel house in line with the arresting rope(s). In addition, if the large vessel overruns the barrier, the materials of the barrier (e.g., wire ropes etc.) would get entangled in the propellers and rudder of the vessel, affording a second method of stopping an attacking large vessel.

The large vessel capture system of one embodiment is a module added onto an existing barrier when in place to augment its capability. An example will now be described with reference to FIGS. 11*a-d*, illustrating a large vessel capture system 1000 incorporated into a barrier similar in all relevant respects to the barrier 1400 of FIG. 1. A cable support pole 1010 extends upward from a top surface of a central column 1020 of each of the inboard hinges 1420, and an upper impact cable 1030 extends substantially horizontally between the cable support poles 1010. The upper impact cable 1030 is disposed between 2.5 m and 7 m above the water, and can comprise Spectra™ or Dyneema™ fiber rope or equivalent high tenacity fiber rope having a diameter of at least 40 cm. The upper impact cable 1030 is for impacting a superstructure or deck gear of a moving vessel when the vessel impacts the first or second impact net 1430, to arrest the motion of the vessel. Each cable support pole 1010 is for breaking away from its associated central column 1020 upon impact with the vessel.

In certain embodiments of the disclosed large vessel capture system shown in FIG. 11 *c*, the cable support poles 1010 are hollow tubes, and the system 1000 further comprises a plurality of rope stays 1040 disposed within the cable support poles 1010, each of the rope stays 1040 attached at one end to the upper impact cable 1030 and at the other end to a lower cable 1050 running through the central columns 2010 to an anchorage for the barrier 1400. The upper impact cable 1030 passes through a soft eye 1040*a* of each vertical rope stay 1040 along the length of the barrier 1400. Each rope stay 1040 also has a soft eye 1040*b* at its base. The vertical rope stays 1040 are, for example, the same diameter as the upper impact cable 1030, or an equivalent strength. The rope stays 1040 are thus in the middle of each "X frame" of the barrier 1400. Tying to the center of an X provides equal spacing of the vertical rope stay elements 1040, longitudinally tying the large vessel capture system 1000 into the strongest parts of barrier 1400, including the central aluminum columns 1020, and the steel horizontal cables 1050 which pass through them.

The vertical tubes 1010 in these embodiments each act as a stanchion supporting the upper impact cable 1030, and provide containment for one of the rope stays 1040. The tubes 1010 are composed of lightweight aluminum or plastic, and support the rope stays 1030 over the barrier 1400 at a height above the water enabling the structure to stop or delay a large vessel by holding the horizontal upper impact cable 1030 at the appropriate height to catch the boat's gear and wheelhouse. This load path from the large vessel capture system 1000 to the barrier 1400 through multiple vertical ropes 1040 facilitates the transfer of kinetic energy rapidly and efficiently through barrier 1400 into the water surrounding the structure.

Figure 11A:
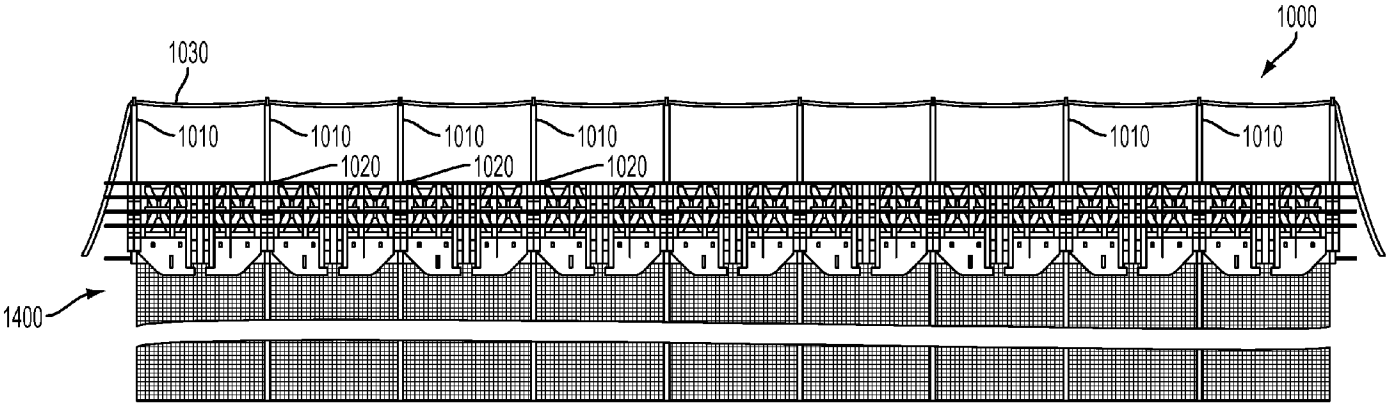
Figure 11B:
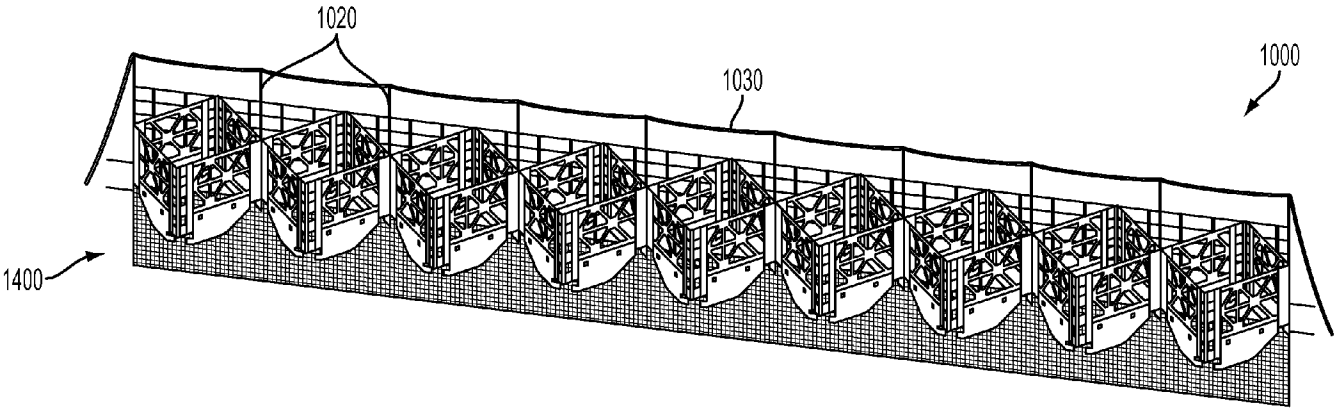
Figure 11C:
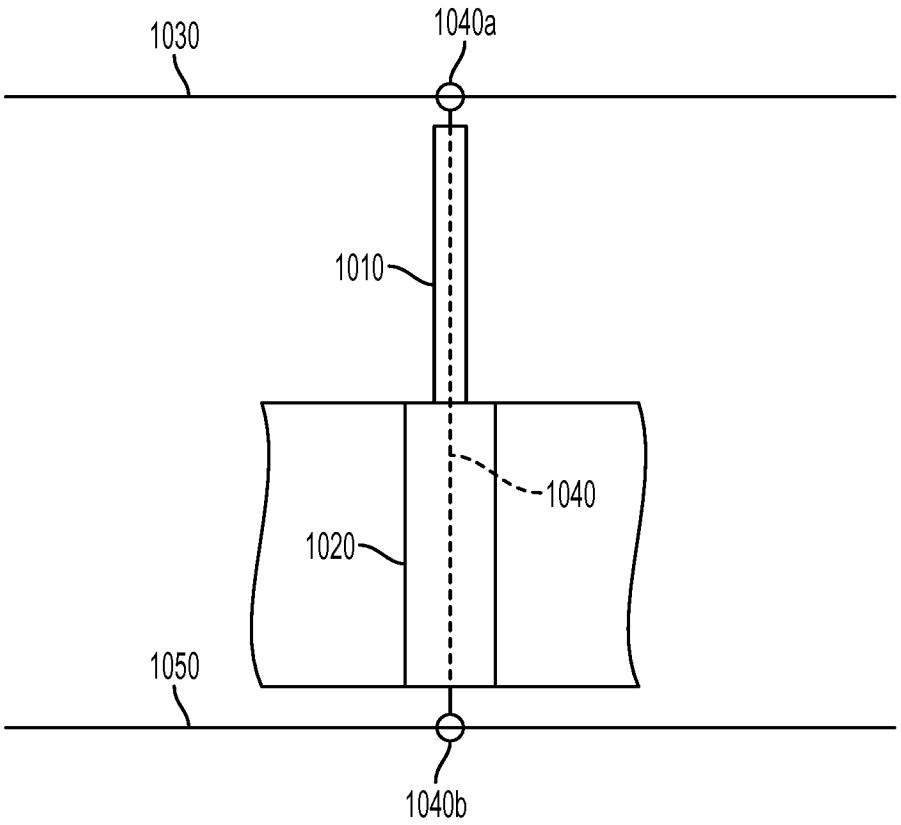
Figure 11D:
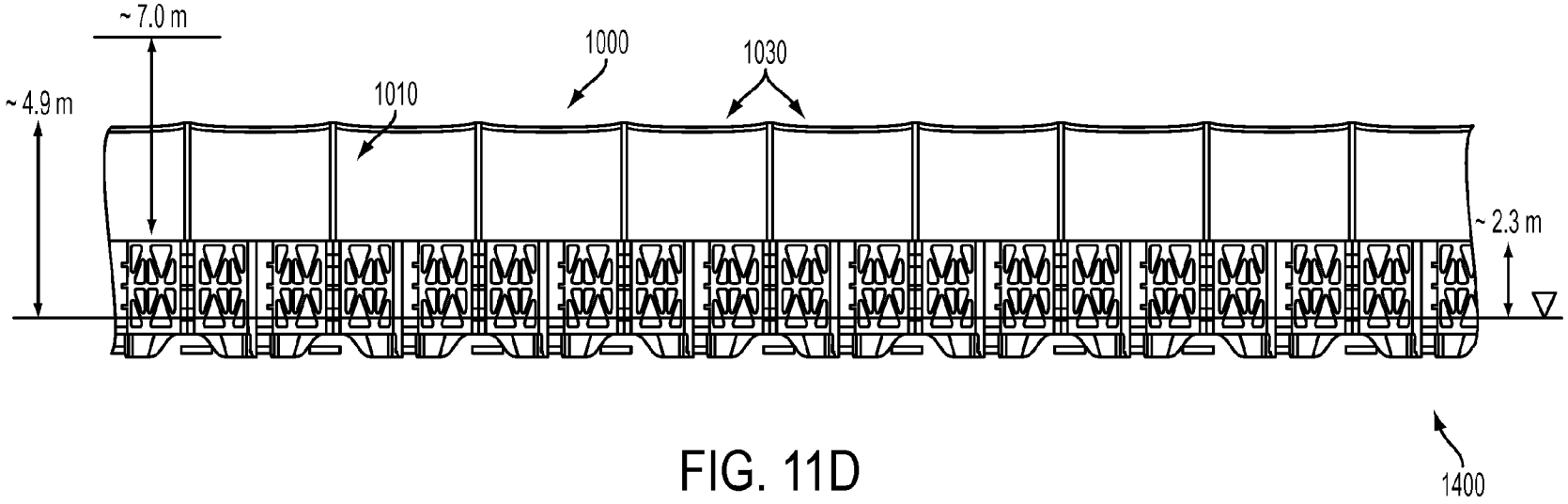

A typical fishing vessel can have bow heights between 2.5 to 5 m above the waterline, which may allow the vessel to ride over the barrier structure on impact. With the large vessel capture system 1000 included, a barrier of the type shown in FIG. 11*a-d*, for example, can counter this threat. In other words, a mounted capture rope system 1000 reaching a height up to 7 meters above the water will delay an attacking fishing vessel by entangling the deck gear and superstructure. The upper impact cable 1030 is elevated to, for example, 4.9 meters above the water by a lightweight aluminum support pole 1010, and secured at regular intervals; e.g., 3.9 meter intervals, to the central columns 1020 of the barrier 1400 (FIG. 11*d*). At each connection, a wire rope stay 1040 is connected to; for example, one or more catenary and tow cables 1050, enabling the upper impact cable 1030 to draw on the capacity and energy dissipation capability of barrier 1400.

In an impact scenario where a large vessel impacts barrier 1400, the vessel begins to overrun barrier 1400, and its deck gear and wheel house get tangled in the large diameter upper impact cable 1030. The kinetic energy of the large vessel's impact is transferred through the upper impact cable 1030 to the vertically oriented rope stays 1040 along the length of barrier 1400. The rope stays 1040 tie to the steel haul cable 1050 used by barrier 1400 to open and close as a maritime gate, which passes through the central columns 1020 of the inboard hinges 420 to the anchorages of barrier 1400.

The large vessel capture system can be composed of multiple ropes, bundled or with horizontal impact cables in staggered heights above the water to optimize engagement with target vessels. The vertical rope stays 1040 can be of the same construction as the upper impact cables 1030, the same strength and elongation, or can be adjusted to promote additional elongation, thereby optimizing energy absorption and transfer.

In the above embodiments, the large vessel capture system 1000 is tied directly into the underlying barrier 1400. In further embodiments, it is tied into independent anchorages at the ends of the barrier.

Those of skill in the art will understand that the disclosed large vessel capture system is also usable with the barriers described herein above with reference to FIGS. 4*a*-9, which include the impact net payout feature described herein above with reference to FIGS. 3*a*-*e*. In these embodiments, cable support pole 1010 extends upward from a top surface of the central column 420*a* of each of the inboard hinges 420, or from the columns of the net connection portions 122, 122*a* of each of the outboard hinges 120 of an outboard row of hinges 410*a*, 410*c*.

The performance of an example of the disclosed large vessel capture system will now be described. An FEA approach was employed to verify the robustness of the large vessel capture system. The system includes a minimum 50 mm diameter upper impact fiber rope resting 2.5 meters above the top of the barrier, resulting in a total height of 4.9 m above the water surface. The rope is held in place with rigid, break away aluminum pipe holding wire rope stays. The poles are designed to break away on impact, keeping the wire ropes intact and the 50 mm fiber rope entangled in the vessel superstructure.

The total kinetic energy of a 70 ton vessel at 15 knots is 1,891 kJ. It can be assumed that the propellers would remain engaged during the collision. The thrust associated with a vessel of this size is approximately 110 KN (24,700 lbf). Therefore, this impact is analyzed for both the kinetic energy and the continued thrust associated with the vessel. Due to the relatively slow vessel speed, it is assumed that the maximum energy is transferred to the barrier within 1.5 seconds, with peak force application at 0.5 seconds.

Figure 12:
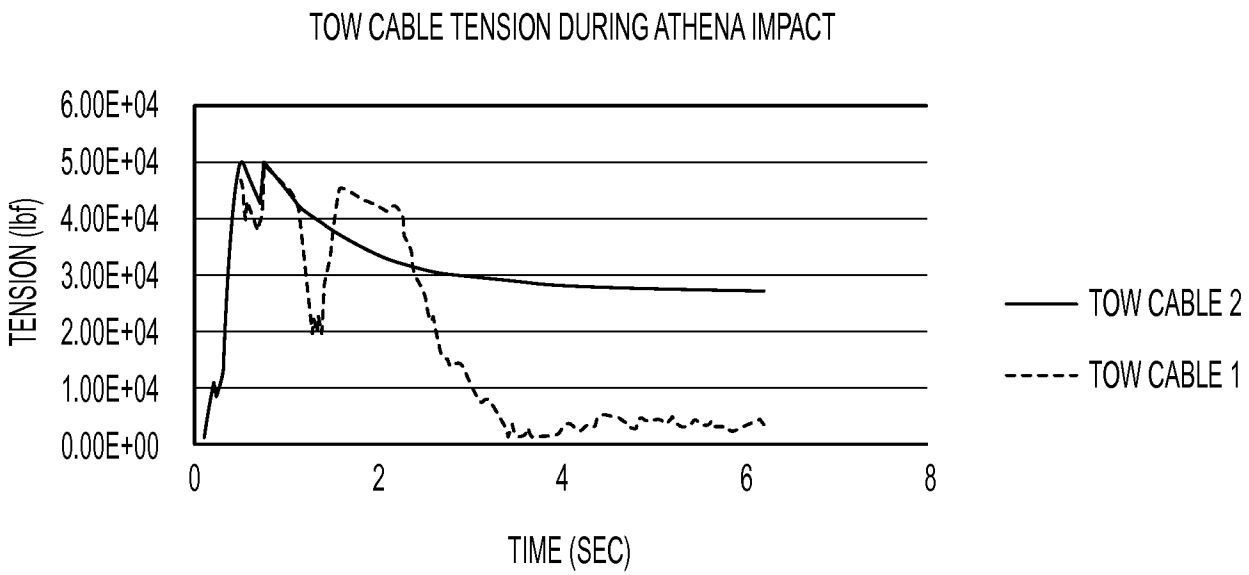
FIG. 12 is a graph illustrating the performance of the large vessel capture system of FIGS. 10-11*d*.

FIG. 12 presents a tow cable tension during the impact event. The barrier design allows winch brake slippage at; for example, 222 KN (50,000 Ibf), mitigating forces in the system. Within 3 seconds after simulated impact, the total force acting on the winch system was below the brake slippage, which arrested the vessel movement.

Figure 13:
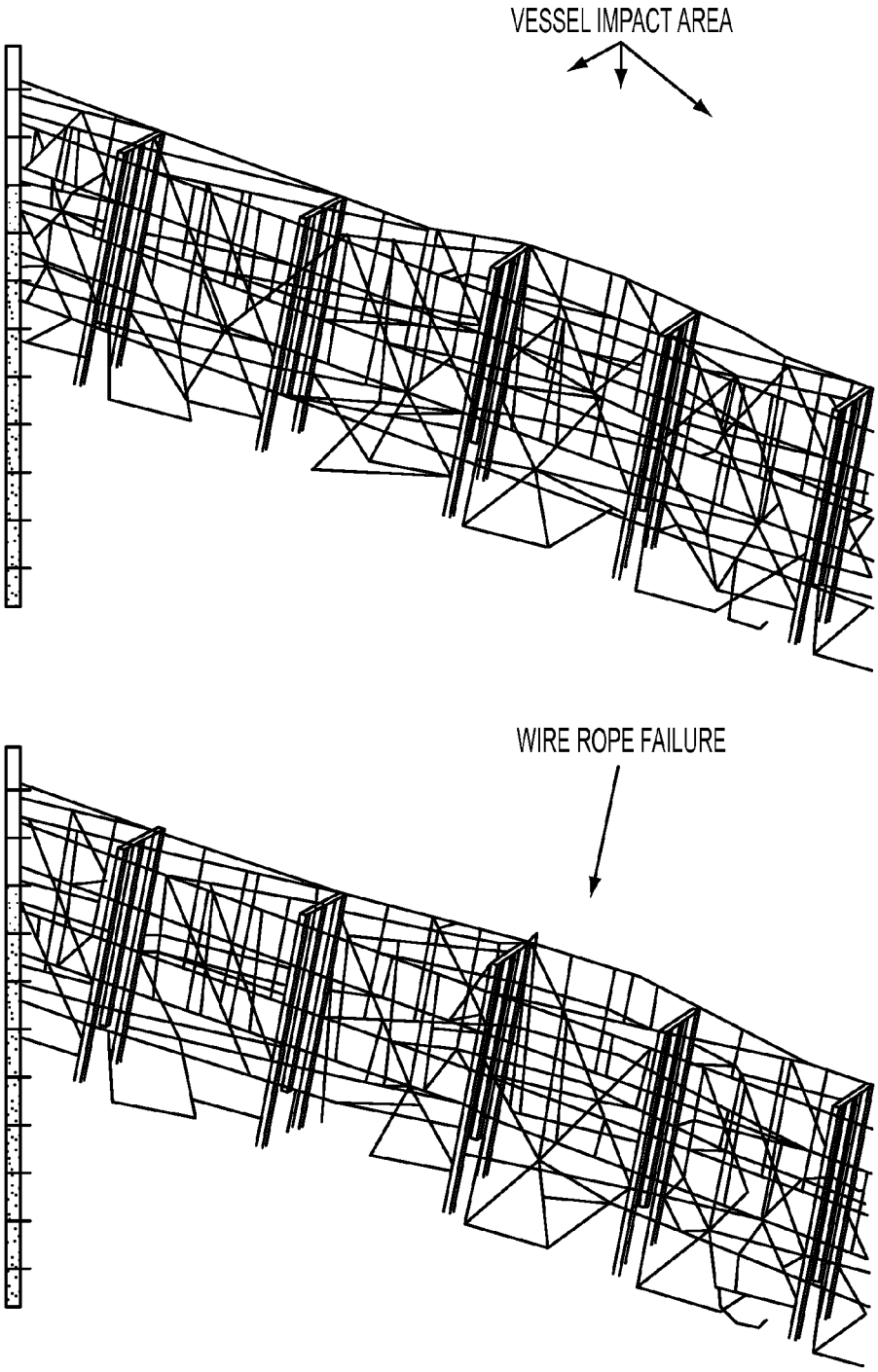
FIG. 13 illustrates the performance of the large vessel capture system of FIGS. 10-11*d*.

The slippage of the winch brakes at tension allowed the initial impulse load of the collision event to be dissipated by the barrier. As the tension fell back below the benchmark, the brakes engaged and delayed the vessel. The vertical wire rope stay securing the upper impact rope to the barrier adjacent to the point of impact was observed to fail, as shown in FIG. 13. However, the remaining vertical stays were intact, keeping the fishing vessel engaged and requiring it to pull the barrier, which significantly reduced its speed. As the brake slip point was reached, the forward motion of the vessel arrested.

It is, therefore, apparent that there is provided in accordance with the present invention, energy absorption management techniques for a marine barrier system. While this invention has been described in conjunction with a number of embodiments, it is evident that many alternatives, modifications and variations would be or are apparent to those of ordinary skill in the applicable arts. Accordingly, applicants intend to embrace all such alternatives, modifications, equivalents and variations that are within the spirit and scope of this invention.

What is claimed is:

1. A marine barrier comprising:

a first plurality of substantially vertical panels, each of the panels having a buoyant bottom portion, and a pair of opposing sides;

a plurality of hinges, each hinge for elastically connecting a side of a first one of the panels to a side of an adjacent second one of the panels with an included angle therebetween, to form a buoyant continuous first pleated row of panels, such that the hinges are arranged in first and second substantially parallel rows, each hinge of the first row of hinges comprising a plurality of elastic portions and a substantially rigid net connection portion; and an impact net comprising a plurality of substantially parallel, substantially horizontal impact cables, each impact cable attached to the net connection portion of each of the hinges in the first row of hinges;

wherein opposite ends of the impact cables each have a cable stop rigidly attached thereto; and wherein the net connection portions of the first row of hinges are attachable to the impact cables with a predetermined tension such that, when the barrier is floating in a body of water and a moving vessel impacts the impact net, a force of the impact causes the impact cables to move relative to the net connection portions, transferring a portion of the force of the impact to the net connection portions, until the cable stops engage corresponding ones of the net connection portions adjacent the cable stops, and after the cable stops engage the corresponding ones of the net connection portions, the force of the impact is transferred to one or more of the first plurality of panels, which in turn engage the water to transfer the force of the impact to the water, to arrest the motion of the vessel.

2. The marine barrier of claim 1, wherein the second row of hinges are inboard hinges, each of which are for joining four of the panels together by elastically connecting a side of an additional one of the panels to a side of an adjacent further additional one of the panels with the included angle therebetween, the barrier further comprising:

a third row of hinges substantially parallel to the second row of hinges, each hinge of the third row of hinges comprising a plurality of elastic portions and a substantially rigid net connection portion;

a second plurality of the panels, each of which has its pair of opposing sides respectively connected to hinges of the second and third row of hinges to form a second continuous pleated row of panels; and a second impact net comprising a plurality of substantially parallel, substantially horizontal second impact cables, each second impact cable attached to the net connection portion of each of the hinges in the third row of hinges;

wherein opposing ends of the second impact cables each have a cable stop rigidly attached thereto; and;

wherein the net connection portions of the third row of hinges are movably attachable to the second impact cables with a predetermined tension such that, when the barrier is floating in a body of water and a moving vessel impacts the second impact net, a force of the impact causes the second impact cables to move relative to the net connection portions of the third row of hinges, transferring a portion of the force of the impact to the net connection portions, until the cable stops of the second impact cables engage corresponding ones of the net connection portions of the third row of hinges adjacent the cable stops, and after the cable stops engage the corresponding ones of the net connection portions, the force of the impact is transferred to one or more of the second plurality of panels, which in turn engage the water, and to one or more of the first plurality of panels, which in turn engage the water, to transfer the force of the impact to the water and arrest the motion of the vessel.

3. The marine barrier of claim 2, wherein the net connection portions of the first and third rows of hinges each comprise a substantially vertical column, and a plurality of U-bolts attachable to the column and respectively engagable with the plurality of impact cables, to press the impact cables against the column to maintain the predetermined tension between the impact cables and the U-bolts.

4. The marine barrier of claim 2, wherein the elastic portions of the hinges each comprise a flexible central portion and a pair of opposed outer faceted portions, wherein one of the faceted portions is for engaging a faceted track in one of the panels to attach the elastic portion to the one of the panels, and the other faceted portion is for engaging a faceted track in one of the net connection portions of one of the first or third row hinges to attach the elastic portion to the one of the net connection portions, or for engaging a faceted track of one of the inboard hinges to attach the elastic portion to the one of the inboard hinges.

5. The marine barrier of claim 2, wherein each of the inboard hinges comprises a substantially vertical central column, the barrier further comprising:

a cable support pole extending upward from a top surface of the central column of each of the inboard hinges; and an upper impact cable extending substantially horizontally between the cable support poles;

wherein the upper impact cable is for impacting a superstructure or deck gear of the moving vessel when the vessel impacts the first or second impact net, to arrest the motion of the vessel.

6. The marine barrier of claim 1, wherein the net connection portions each comprise a substantially vertical column, and a plurality of U-bolts attachable to the column and respectively engagable with the plurality of impact cables, to press the impact cables against the column to maintain the predetermined tension between the impact cables and the U-bolts.

7. The marine barrier of claim 6 or 3, wherein the U-bolts each comprise insulators to isolate the U-bolt and the impact cable engaged by the U-bolt from the column.

8. The marine barrier of claim 1 or 2, wherein the panels are movable from an expanded position where adjacent ones of the panels are disposed with the included angle therebetween, to a retracted position where the panels are substantially parallel to each other.

9. The marine barrier of claim 8, further including:

a rigidly mounted first winch having a friction brake; and a first tow cable attached to the first winch and attached to an end hinge of one of the rows of hinges and passing through the other hinges of that row of hinges, for moving the panels from the expanded position to the retracted position by operation of the first winch;

wherein when the panels are in the expanded position and the moving vessel impacts one of the impact nets, and the barrier transfers the force of the impact to the water, the first tow cable pays out from the first winch by operation of the friction brake of the first winch, to absorb a portion of the kinetic energy of the impact.

10. The marine barrier of claim 9, further including:

a rigidly mounted second winch having a friction brake; and a second tow cable attached to the second winch and attached to the end hinge of one of the rows of hinges, for moving the panels from the retracted position to the expanded position by operation of the second winch;

wherein when the panels are in the expanded position and the moving vessel impacts one of the impact nets, and the barrier transfers the force of the impact to the water, the second tow cable pays out from the second winch by operation of the friction brake of the second winch, to absorb a portion of the kinetic energy of the impact.

11. The marine barrier of claim 1, wherein the elastic portions of the hinges each comprise a flexible central portion and a pair of opposed outer faceted portions, wherein one of the faceted portions is for engaging a faceted track in one of the panels to attach the elastic portion to the one of the panels, and the other faceted portion is for engaging a faceted track of one of the net connection portions of one of the first row of hinges to attach the elastic portion to the one of the net connection portions.

12. The marine barrier of claim 11 or 4, wherein the elastic portions comprise EPDM rubber having a Durometer value of about 50 to about 80.

13. The marine barrier of claim 11 or 4, wherein the elastic portions each comprise a longitudinal through-hole in each of their faceted portions, and a pair of retaining rods for insertion into the through-holes for retaining the elastic portions in the faceted tracks.

14. The marine barrier of claim 13, further comprising a plurality of retaining pins, each insertable into a transverse hole proximal an end of each of the retaining rods, for retaining the retaining rods in the faceted portions of the elastic portions.

15. The marine barrier of claim 13, further comprising a plurality of capture bolts, each insertable into a pair of opposing through-holes in one of the faceted tracks, to locate and retain one of the elastic portions in the track.

16. The marine barrier of claim 11 or 4, wherein the faceted tracks are each for engaging two of the elastic portions.

17. The marine barrier of claim 16, comprising a spacer disposed between the two elastic portions.

18. A marine barrier comprising:

a first plurality of substantially vertical panels, each of the panels having a buoyant bottom portion and a pair of opposing sides;

a plurality of hinges, each hinge for elastically connecting a side of a first one of the panels to a side of an adjacent second one of the panels with an included angle therebetween, to form a buoyant continuous first pleated row of panels, such that the hinges are arranged in first and second substantially parallel rows; and an impact cable attached to opposing ends of the first pleated row of panels and passing through each of the hinges in the first row of hinges;

wherein when the barrier is floating in a body of water and a moving vessel impacts the impact cable, the impact cable deflects to transfer a force of the impact to one or more of the first plurality of panels, which in turn engage the water to transfer the force of the impact to the water, to arrest the motion of the vessel;

wherein a plurality of hinges of the second row of hinges are inboard hinges, each of which are also for joining four of the panels together by elastically connecting a side of an additional one of the panels to a side of an adjacent further additional one of the panels with the included angle therebetween, the barrier further comprising:

a third row of hinges substantially parallel to the second row of hinges;

a second plurality of the panels, each of which has its pair of opposing sides respectively connected to hinges of the second and third row of hinges to form a second continuous pleated row of panels; and a second impact cable attached to opposing ends of the second pleated row of panels and passing through each of the hinges in the third row of hinges;

wherein when the barrier is floating in the body of water and a moving vessel impacts the second impact cable, the second impact cable deflects to transfer a force of the impact to one or more of the second plurality of panels, which in turn engage the water, and to one or more of the first plurality of panels, which in turn engage the water, to transfer the force of the impact to the water and arrest the motion of the vessel;

wherein each of the inboard hinges comprises a substantially vertical central column, the barrier further comprising:

a cable support pole extending upward from a top surface of the central column of each of the inboard hinges; and an upper impact cable extending substantially horizontally between the cable support poles;

wherein the upper impact cable is for impacting a superstructure or deck gear of the moving vessel when the vessel impacts the first or second impact net, to arrest the motion of the vessel.

19. The marine barrier of claim 5 or 18, wherein the upper impact cable is disposed between 2.5 m and 7 m above the water.

20. The marine barrier of claim 5 or 18, wherein the upper impact cable comprises a synthetic fiber rope having a diameter of at least 40 cm.

21. The marine barrier of claim 5 or 18, wherein each cable support pole is for breaking away from its associated central column upon impact with the vessel.

22. The marine barrier of claim 5 or 18, further comprising a plurality of rope stays disposed within the cable support poles, each of the rope stays attached at one end to the upper impact cable and at the other end to a lower cable running through the central columns to an anchorage for the barrier.

* * * * *